US011256207B2

(12) United States Patent
Sato et al.

(10) Patent No.: US 11,256,207 B2
(45) Date of Patent: Feb. 22, 2022

(54) IMAGE FORMING DEVICE

(71) Applicant: BROTHER KOGYO KABUSHIKI KAISHA, Nagoya (JP)

(72) Inventors: Shougo Sato, Seto (JP); Kazuna Taguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/999,794

(22) Filed: Aug. 21, 2020

(65) Prior Publication Data

US 2021/0063949 A1 Mar. 4, 2021

(30) Foreign Application Priority Data

Sep. 2, 2019 (JP) ..... JP2019-159903

(51) Int. Cl.
*G03G 15/02* (2006.01)
*G03G 21/16* (2006.01)

(52) U.S. Cl.
CPC ..... *G03G 21/1647* (2013.01); *G03G 21/1671* (2013.01); *G03G 21/1676* (2013.01)

(58) Field of Classification Search
CPC .. G03G 15/116; G03G 21/10; G03G 21/1647; G03G 21/1671; G03G 21/1676; G03G 21/1842; G03G 21/1853; G03G 2221/183
USPC ..... 399/107, 110, 111, 116, 119, 120
See application file for complete search history.

(56) References Cited

U.S. PATENT DOCUMENTS 8,565,637 B2 * 10/2013 Itabashi ..... G03G 15/0875 399/110
8,737,867 B2 * 5/2014 Sato ..... G03G 21/1633 399/101
2016/0139558 A1 5/2016 Kawakami et al.

FOREIGN PATENT DOCUMENTS

JP H06-19237 A 1/1994
JP 2016099403 A 5/2016
JP 2016166981 A 9/2016

* cited by examiner

*Primary Examiner* — Hoan H Tran
(74) *Attorney, Agent, or Firm* — Merchant & Gould P.C.

(57) ABSTRACT

An image forming device, including: a housing; a drawer movable between an inside position at which the drawer is located inside the housing and an outside position at which the drawer is located outside the housing; a drum cartridge including a photoconductive drum and a developer roller and mountable on the drawer; and a toner cartridge storing toner to be supplied to the developer roller and mountable on the drawer, wherein the drum cartridge and the toner cartridge are mountable on the drawer in a state in which the drawer is located at the outside position, and wherein the drum cartridge and the toner cartridge are arranged in a drawer moving direction in which the drawer moves, in the state in which the drum cartridge and the toner cartridge are mounted on the drawer.

16 Claims, 14 Drawing Sheets

IMAGE FORMING DEVICE

CROSS REFERENCE TO RELATED APPLICATION

The present application claims priority from Japanese Patent Application No. 2019-159903, which was filed on Sep. 2, 2019, the disclosure of which is herein incorporated by reference in its entirety.

BACKGROUND

Technical Field

The following disclosure relates to an image forming device.

Description of Related Art

An image forming device conventionally incudes a housing, a drum cartridge, and a toner cartridge. The drum cartridge includes a photoconductive drum and a developer roller. The drum cartridge is mountable on the image forming device. The toner cartridge stores toner to be supplied to the developer roller. The toner cartridge is mountable on the image forming device.

SUMMARY

In replacing the toner cartridge and the drum cartridge of the known image forming device described above, the user has to replace the toner cartridge and the drum cartridge utilizing a small or narrow space in a housing of the image forming device, thus making it difficult for the user to replace the toner cartridge and the drum cartridge.

Accordingly, one aspect of the present disclosure is directed to an image forming device that facilitates replacement of the toner cartridge and the drum cartridge.

In one aspect of the present disclosure, an image forming device includes: a housing; a drawer movable between an inside position at which the drawer is located inside the housing and an outside position at which the drawer is located outside the housing; a drum cartridge including a photoconductive drum and a developer roller and mountable on the drawer; and a toner cartridge storing toner to be supplied to the developer roller and mountable on the drawer, wherein the drum cartridge and the toner cartridge are mountable on the drawer in a state in which the drawer is located at the outside position, and wherein the drum cartridge and the toner cartridge are arranged in a drawer moving direction in which the drawer moves, in the state in which the drum cartridge and the toner cartridge are mounted on the drawer.

In another aspect of the present disclosure, an image forming device includes: a housing; a drawer movable between an inside position at which the drawer is located inside the housing and an outside position at which the drawer is located outside the housing; a drum cartridge including a photoconductive drum and mountable on the drawer; a developer roller that supplies toner to the photoconductive drum; a toner cartridge storing the toner to be supplied to the developer roller and mountable on the drawer; and an exposure device, wherein the drum cartridge and the toner cartridge are mountable on the drawer in a state in which the drawer is located at the outside position, wherein the drawer has a through-hole, and wherein the exposure device exposes a surface of the photoconductive drum through the through-hole of the drawer in a state in which the drum cartridge and the toner cartridge are mounted on the drawer and the drawer is located at the inside position.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

1. Image Forming Device 1

Referring to FIGS. 1-4, there will be explained an image forming device 1 according to one embodiment.

Figure 1:
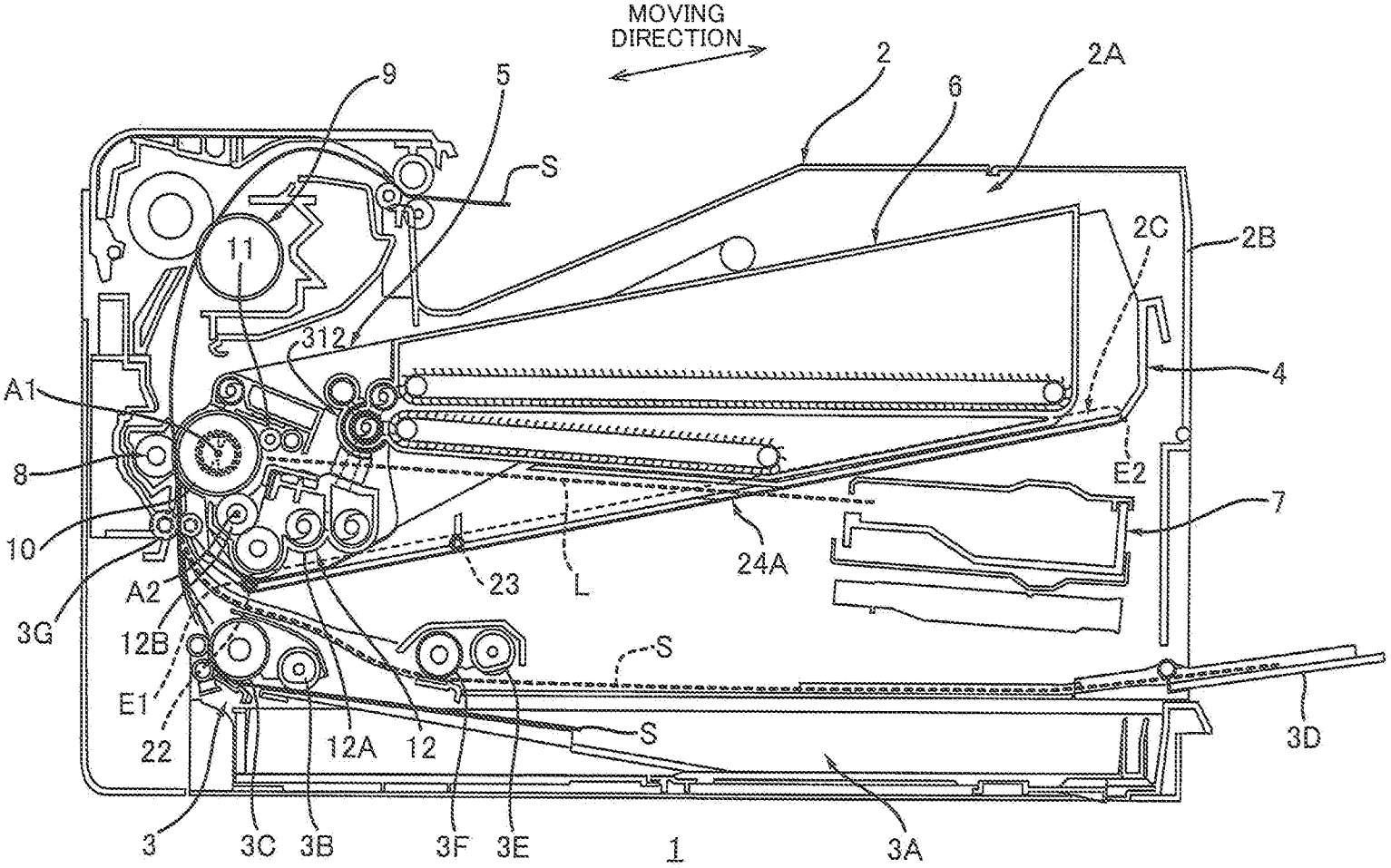
FIG. 1 is a schematic view of an image forming device according to one embodiment.

As shown in FIG. 1, the image forming device 1 incudes a housing 2, a sheet supplier 3, a drawer 4, a drum cartridge 5, a toner cartridge 6, an exposure device 7, a transfer roller 8, and a fixing device 9. The image forming device 1 is for monochrome printing. Thus, the image forming device 1 includes one drum cartridge 5 and one toner cartridge 6.

1.1 Housing 2

Figure 2:
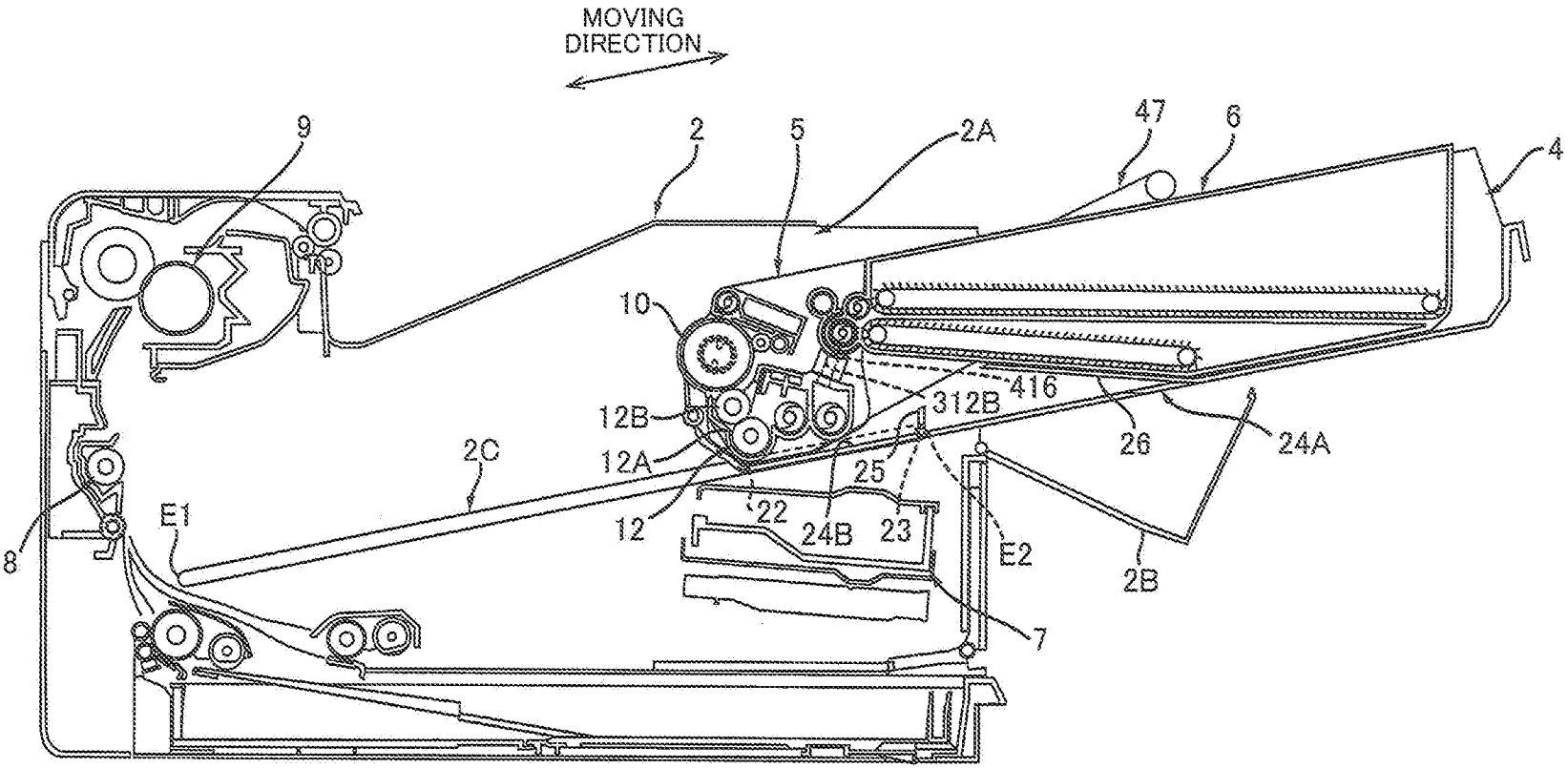
FIG. 2 illustrates a state in which a drawer illustrated in FIG. 1 is located at an outside position.

The housing 2 houses the sheet supplier 3, the drawer 4, the drum cartridge 5, the toner cartridge 6, the exposure device 7, the transfer roller 8, and the fixing device 9. The housing 2 has an opening 2A (FIG. 2). The housing 2 has a cover 2B.

As shown in FIGS. 1 and 2, the cover 2B is movable between a closed position (FIG. 1) and an open position (FIG. 2). In a state in which the cover 2B is located at the closed position, the cover 2B closes the opening 2A. In a state in which the cover 2B is located at the open position, the cover 2B opens the opening 2A.

1.2 Sheet Supplier 3

As shown in FIG. 1, the sheet supplier 3 is capable of supplying sheets S to the photoconductive drum 10. The photoconductive drum 10 will be later explained. The sheet supplier 3 includes a sheet cassette 3A, a pickup roller 3B, a conveying roller 3C, a multi-purpose tray 3D, a pickup roller 3E, a conveying roller 3F, and a conveying roller 3G.

The sheet cassette 3A is capable of storing sheets S. The pickup roller 3B picks up an uppermost one of the sheet S stacked on the sheet cassette 3A and conveys the picked-up sheet S toward the conveying roller 3C. The conveying roller 3C conveys the sheet S conveyed from the pickup roller 3B toward the conveying roller 3G.

A sheet S can be placed on the multi-purpose tray 3D. The pickup roller 3E picks up the sheet S placed on the multi-purpose tray 3D and conveys the picked-up sheet S toward the conveying roller 3F. The conveying roller 3F conveys the sheet S conveyed from the pickup roller 3E toward the conveying roller 3G.

The conveying roller 3G conveys, toward the photoconductive drum 10, the sheet S conveyed from the conveying roller 3C or the sheet S conveyed from the conveying roller 3F.

1.3 Drawer 4

The drum cartridge 5 and the toner cartridge 6 can be placed on the drawer 4. The drawer 4 is movable between an inside position (FIG. 1) and an outside position (FIG. 2). A direction in which the drawer 4 moves intersects an up-down direction. This direction will be hereinafter referred to as "drawer moving direction" where appropriate. The drawer 4 inclines upward in a direction directed from the inside position toward the outside position. The drawer 4 is movable between the inside position and the outside position in a state in which the drum cartridge 5 and the toner cartridge 6 are placed thereon.

Specifically, the housing 2 includes a guide 2C (FIG. 2). The guide 2C guides the drawer 4. The guide 2C extends in the drawer moving direction. The guide 2C includes a first end portion E1 and a second end portion E2. The second end portion E2 is apart from the first end portion E1 in the drawer moving direction. The second end portion E2 is located between the first end portion E1 and the cover 2B in the drawer moving direction.

As shown in FIG. 1, the inside position is a position at which a guided portion 22 (FIG. 5) of the drawer 4 engages the first end portion E1 of the guide 2C. The guided portion 22 will be later explained. In a state in which the drawer 4 is located at the inside position, the entirety of the drawer 4 is located inside the housing 2.

As shown in FIG. 2, the outside position is a position at which a guided portion 23 (FIG. 5) of the drawer 4 engages the second end portion E2 of the guide 2C. The guided portion 23 will be later explained in detail. In a state in which the drawer 4 is located at the outside position, at least a part of the drawer 4 is located outside the housing 2.

1.4 Drum Cartridge 5

Figure 3:
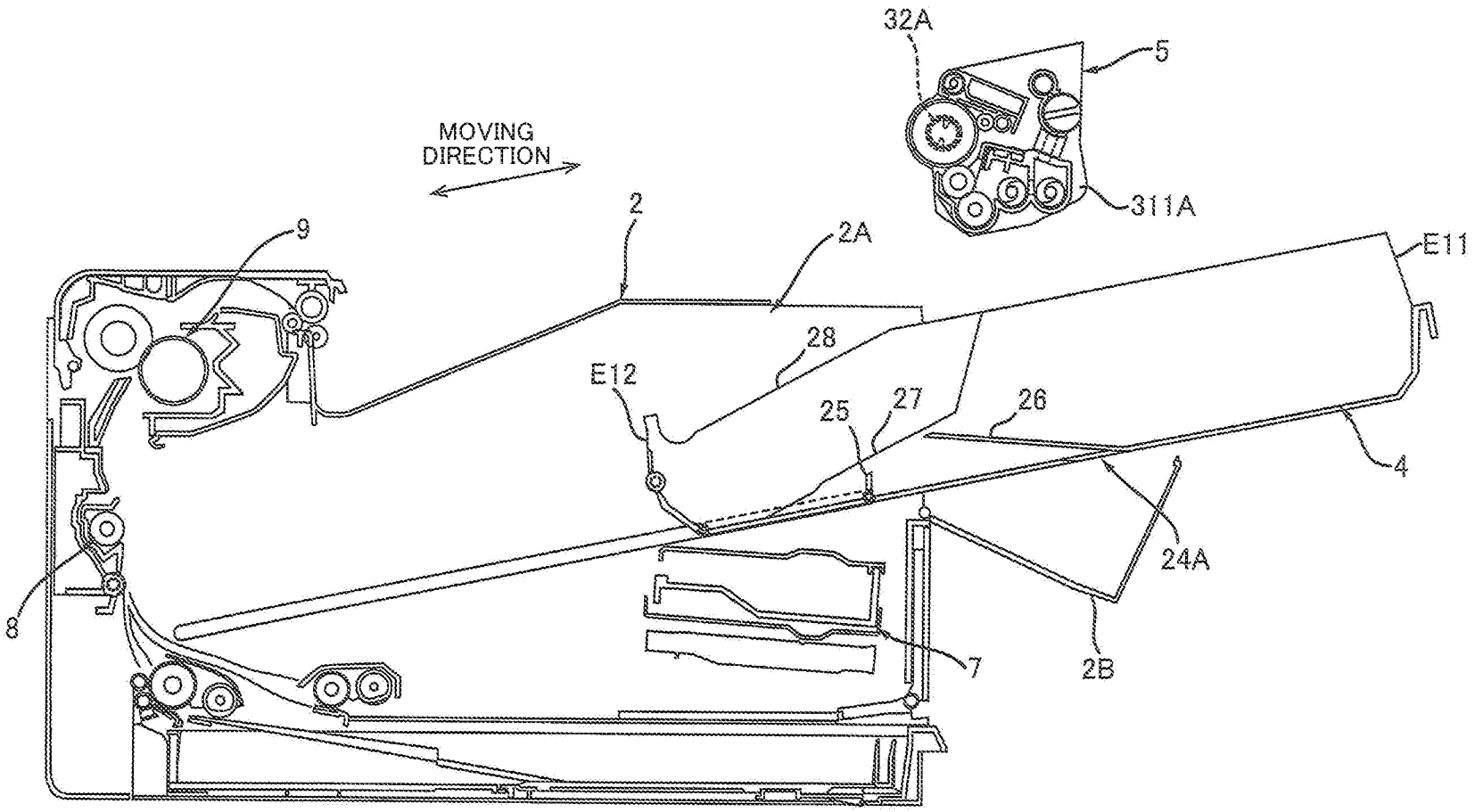
FIG. 3 illustrates a state in which the drawer illustrated in FIG. 1 is located at the outside position and a drum cartridge and a toner cartridge are detached from the drawer.
Figure 4:
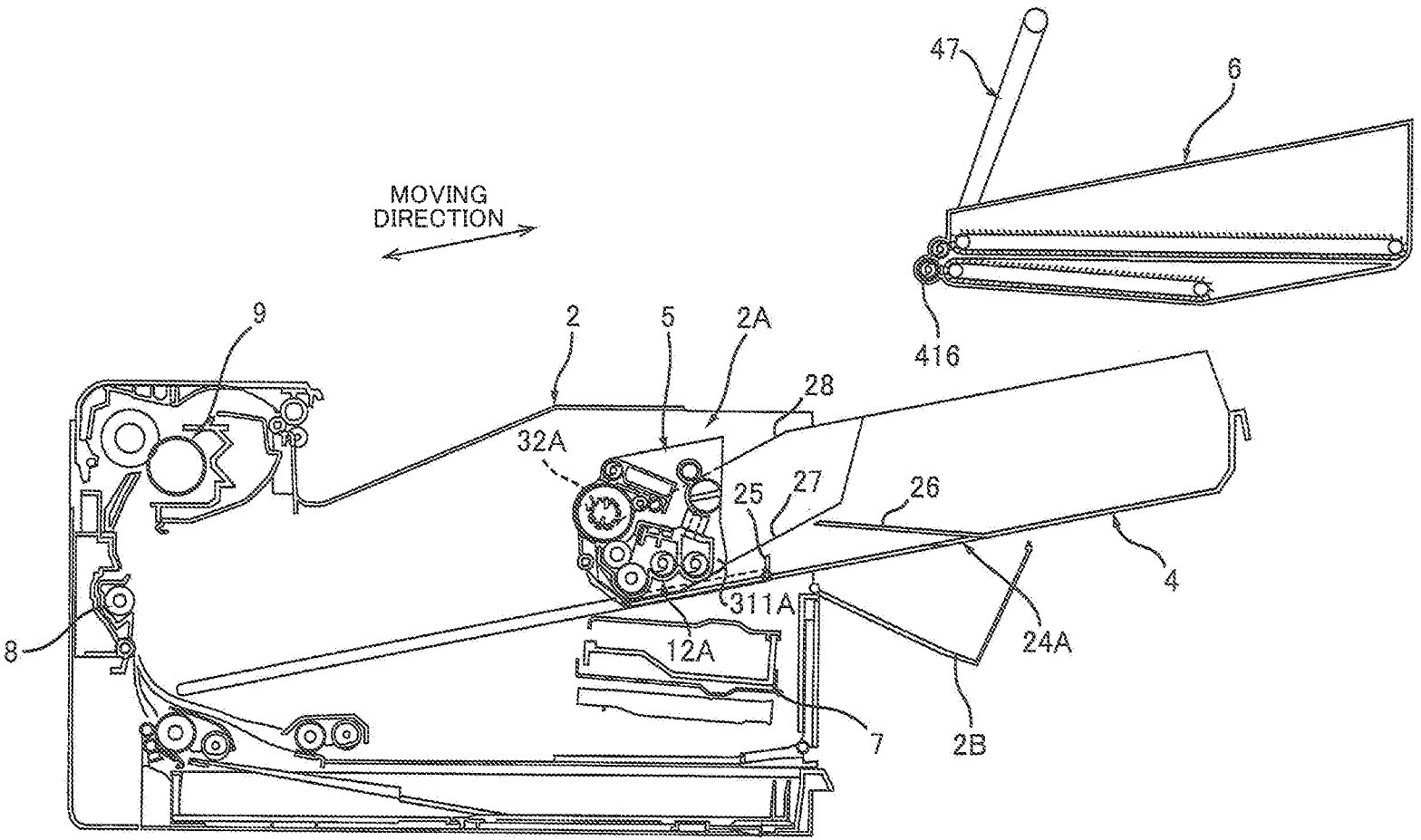
FIG. 4 illustrates a state in which the drum cartridge is mounted on the drawer illustrated in FIG. 3.

As shown in FIGS. 3 and 4, the drum cartridge 5 is mountable on the drawer 4 in the state in which the drawer 4 is located at the outside position. The state in which the drum cartridge 5 is mounted on the drawer 4 refers to a state in which the drum cartridge 5 is placed at a specific position on the drawer 4. The drum cartridge 5 need not be fixed to the drawer 4 in the state in which the drum cartridge 5 is mounted on the drawer 4.

As shown in FIG. 4, at least a part of the drum cartridge 5 is located inside the housing 2 in a state in which the drum cartridge 5 is mounted on the drawer 4 and the drawer 4 is located at the outside position. Specifically, the entirety of the drum cartridge 5 is located inside the housing 2 in the state in which the drum cartridge 5 is mounted on the drawer 4 and the drawer 4 is located at the outside position.

As shown in FIG. 1, the drum cartridge 5 includes the photoconductive drum 10, a charging roller 11, and a developer device 12.

The photoconductive drum 10 is rotatable about an axis A1 that extends in a first direction. The first direction intersects the drawer moving direction and the up-down direction. Preferably, the first direction is orthogonal to the drawer moving direction and the up-down direction. The photoconductive drum 10 extends in the first direction and has a cylindrical shape.

The charging roller 11 causes the surface of the photoconductive drum 10 to be charged. The charging roller 11 is in contact with the surface of the photoconductive drum 10. The drum cartridge 5 may include a scorotron charging device in place of the charging roller 11.

The developer device 12 is capable of supplying the toner to the photoconductive drum 10. Specifically, the developer device 12 includes a developer housing 12A and a developer roller 12B. That is, the drum cartridge 5 includes the developer housing 12A and the developer roller 12B.

The developer housing 12A stores the toner to be supplied to the photoconductive drum 10. The developer housing 12A supports the developer roller 12B.

The developer roller 12B is rotatable about an axis A2 that extends in the first direction. The developer roller 12B is in contact with the photoconductive drum 10. The developer roller 12B is capable of supplying the toner in the developer housing 12A to the photoconductive drum 10.

1.5 Toner Cartridge 6

As shown in FIGS. 4 and 2, the toner cartridge 6 is mountable on the drawer 4 in the state in which the drawer 4 is located at the outside position. Specifically, the toner cartridge 6 is mountable on the drawer 4 in the state in which the drawer 4 is located at the outside position and the drum cartridge 5 is mounted on the drawer 4. The state in which the toner cartridge 6 is mounted on the drawer 4 refers to a state in which the toner cartridge 6 is placed at a specific position on the drawer 4. The toner cartridge 6 need not be fixed to the drawer 4 in the state in which the toner cartridge 6 is mounted on the drawer 4.

As shown in FIG. 2, the drum cartridge 5 and the toner cartridge 6 are arranged in the drawer moving direction in a state in which the drum cartridge 5 and the toner cartridge 6 are mounted on the drawer 4. The toner cartridge 6 is located opposite to the transfer roller 8 with respect to the drum cartridge 5 in the drawer moving direction in the state in which the drum cartridge 5 and the toner cartridge 6 are mounted on the drawer 4.

The toner cartridge 6 stores the toner to be supplied to the developer device 12. In other words, the toner cartridge 6 stores the toner to be supplied to the developer roller 12B.

1.6 Exposure Device 7

As shown in FIG. 1, the exposure device 7 is capable of exposing the surface of the photoconductive drum 10 in a state in which the drum cartridge 5 and the toner cartridge 6 are mounted on the drawer 4 and the drawer 4 is located at the inside position. Specifically, the exposure device 7 is a laser scanning unit.

The exposure device 7 exposes the surface of the photoconductive drum 10 in the state in which the surface of the photoconductive drum 10 is charged by the charging roller 11, so that a latent image is formed on the surface of the photoconductive drum 10. The developer device 12 supplies the toner onto the surface of the photoconductive drum 10 in the state in which the latent image is formed on the photoconductive drum 10, so that a toner image is formed on the surface of the photoconductive drum 10.

1.7 Transfer Roller 8

The transfer roller 8 is in contact with the photoconductive drum 10 in the state in which the drawer 4, on which the drum cartridge 5 is mounted, is located at the inside position. The sheet S conveyed by the conveying roller 3G passes between the transfer roller 8 and the photoconductive drum 10. In this instance, the transfer roller 8 transfers, to the sheet S, the toner image formed on the surface of the photoconductive drum 10.

1.8 Fixing Device 9

The fixing device 9 heats and pressurizes the sheet S on which the toner image has been transferred, so as to fix the toner image on the sheet S. The sheet S that has passed the fixing device 9 is discharged onto an upper surface of the housing 2.

2. Details of Drawer 4

Referring next to FIGS. 1-9A, the drawer 4 will be explained.

The drawer 4 is shaped like a tray. The drawer 4 includes a pair of side plates 21, the guided portions 22, 23, a plate 24, a first wall 25, and a second wall 26.

2.1 Side Plate 21

The following explanation will be made focusing on one side plate 21. The side plate 21 extends in the drawer moving direction. The side plate 21 includes a first end portion E11 and a second end portion E12 in the drawer moving direction. The second end portion E12 is apart from the first end portion E11 in the drawer moving direction. The second end portion E12 is located between the first end portion E11 and the transfer roller 8 (FIG. 3) in the drawer moving direction. The side plate 21 includes a guide 27 (as one example of "first guide") and a guide 28 (as one example of "second guide"). That is, the drawer 4 includes the guide 27 and the guide 28.

2.1.1 Guide 27

The guide 27 guides a side plate 311A (FIG. 9A) of the drum cartridge 5 in mounting the drum cartridge 5 on the drawer 4 (FIGS. 3 and 4). The side plate 311A will be later explained.

The guide 27 extends in the drawer moving direction. The guide 27 inclines with respect to the drawer moving direction. The guide 27 gets closer to the plate 24 as the guide 27 gets closer to the second end portion E12 of the side plate 21.

2.1.2 Guide 28

The guide 28 guides a guided portion 32A (FIG. 6) of the drum cartridge 5 in mounting the drum cartridge 5 on the drawer 4 (FIGS. 3 and 4). According to this arrangement, the guide 28 guides the photoconductive drum 10 via the guided portion 32A in mounting the drum cartridge 5 on the drawer 4. The guided portion 32A will be later explained.

The guide 28 is located above and apart from the guide 27. The guide 28 extends in the drawer moving direction. The guide 28 inclines with respect to the drawer moving direction. The guide 28 gets closer to the plate 24 as the guide 28 gets closer to the second end portion E12.

2.2 Guided Portions 22, 23

The guided portion 22 engages the guide 2C (FIG. 2) of the housing 2. The guided portion 22 is guided by the guide 2C. The guided portion 22 is a protrusion. The guided portion 22 extends from the side plate 21. The guided portion 22 may be attached to the side plate 21. The guided portion 22 has a cylindrical shape.

The guided portion 23 is apart from the guided portion 22 in the drawer moving direction. The guided portion 23 is located between the guided portion 22 and the first end portion E11 of the side plate 21 in the drawer moving direction. The guided portion 23 is located between the second wall 26 and the guided portion 22 in the drawer moving direction. The guided portion 23 and the first wall 25 are arranged in the first direction. The guided portion 23 engages the guide 2C (FIG. 2) of the housing 2. The guided portion 23 is guided by the guide 2C. The guided portion 23 is a protrusion. The guided portion 23 extends from the side plate 21. The guided portion 23 may be attached to the side plate 21. The guided portion 23 has a cylindrical shape.

2.3 Plate 24

The plate 24 is located below the drum cartridge 5 and the toner cartridge 6 mounted on the drawer 4. The plate 24 extends in the drawer moving direction. The plate 24 has a through-hole 24A and a toner receiving portion 24B. In other words, the drawer 4 has the through-hole 24A and the toner receiving portion 24B.

2.3.1 Through-Hole 24A

The through-hole 24A is apart from the first wall 25 in the drawer moving direction. As shown in FIG. 2, the through-hole 24A is apart from a toner discharge opening 416 in the horizontal direction in the state in which the drum cartridge 5 and the toner cartridge 6 are mounted on the drawer 4. In a case where a part of the toner discharged from the toner discharge opening 416 is not received by the toner inlet opening 312B and accordingly spills outside, the spilled toner is prevented from entering the through-hole 24A. The toner discharge opening 416 and the toner inlet opening 312B will be later explained.

As shown in FIG. 1, light L emitted from the exposure device 7 in the state in which the drum cartridge 5 and the toner cartridge 6 are mounted on the drawer 4 and the drawer 4 is located at the inside position passes through the through-hole 24A. Thus, the exposure device 7 exposes the surface of the photoconductive drum 10 through the through-hole 24A in the state in which the drum cartridge 5 and the toner cartridge 6 are mounted on the drawer 4 and the drawer 4 is located at the inside position.

2.3.2 Toner Receiving Portion 24B

Figure 5:
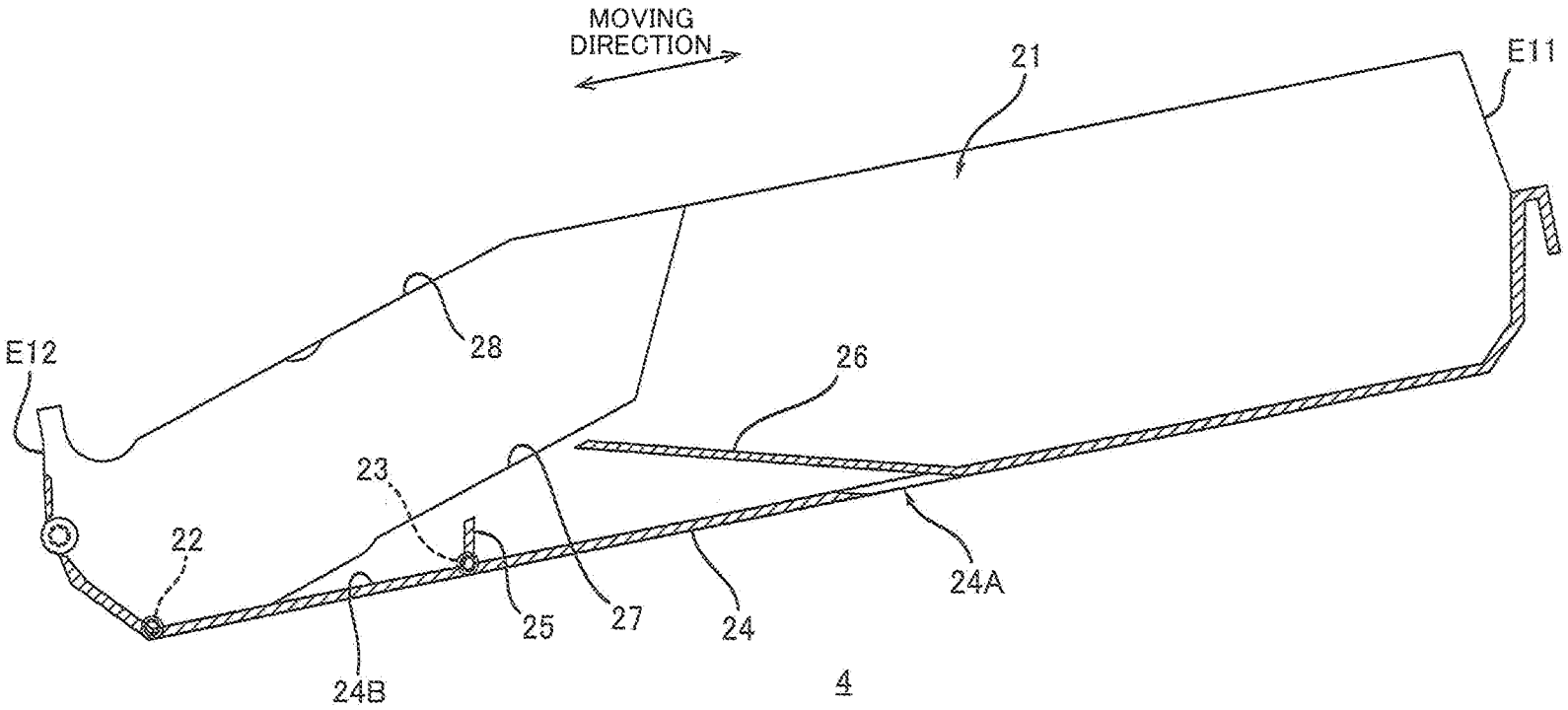
FIG. 5 is a cross-sectional view of the drawer.

As shown in FIG. 5, the toner receiving portion 24B is a part of the plate 24. The toner receiving portion 24B is apart from the through-hole 24A in the drawer moving direction. Specifically, the toner receiving portion 24B is located opposite to the through-hole 24A with respect to the first wall 25 in the drawer moving direction. The toner receiving portion 24B need not necessarily be a part of the plate 24. The toner receiving portion 24B may be a sponge or nonwoven fabric such as felt attached on the plate 24.

As shown in FIG. 2, the toner receiving portion 24B is located below the toner discharge opening 416 and the toner inlet opening 312B in the state in which the drum cartridge 5 and the toner cartridge 6 are mounted on the drawer 4. Thus, the toner receiving portion 24B can receive the toner that has not been received by the toner inlet opening 312B. Specifically, in a case where the toner discharged from the toner discharge opening 416 is not received by the toner inlet opening 312B and accordingly spills outside, the spilled toner can be received by the toner receiving portion 24B of the drawer 4. This configuration prevents the interior of the image forming device 1 from being soiled with the spilled toner.

The toner receiving portion 24B inclines more downward as the toner receiving portion 24B gets away from the through-hole 24A. Owing to the inclination of the toner receiving portion 24, the toner received by the toner receiving portion 24B flows in a direction away from the through-hole 24A, thus preventing the toner received by the toner receiving portion 24B from flowing toward the through-hole 24A. The toner receiving portion 24B does not contact the drum cartridge 5 in the state in which the drum cartridge 5 is mounted on the drawer 4, thus preventing the drum cartridge 5 from being soiled with the toner received by the toner receiving portion 24B.

2.4 First Wall 25

As shown in FIG. 5, the first wall 25 is located between the toner receiving portion 24B and the through-hole 24A of the drawer 4. Thus, the first wall 25 prevents the toner received by the toner receiving portion 24B from flowing toward the through-hole 24A. The first wall 25 is provided on the upper surface of the plate 24 so as to extend therefrom. The first wall 25 may be attached to the upper surface of the plate 24. The first wall 25 may be attached to the side plate 21. The first wall 25 extends in the up-down direction.

2.5 Second Wall 26

The second wall 26 is located above the through-hole 24A of the drawer 4. Even if the toner spills and flows in a direction from the toner discharge opening 416 of the toner cartridge 6 toward the through-hole 24A when the toner cartridge 6 is detached from or mounted on the drawer 4 as shown in FIG. 3, the toner can be received by the second wall 26. As a result, the spilled toner is prevented from entering the through-hole 24A.

As shown in FIG. 5, the second wall 26 extends from the upper surface of the plate 24. The second wall 26 may be attached to the upper surface of the plate 24. The second wall 26 may be attached to the side plate 21. The second wall 26 extends in the horizontal direction.

As shown in FIGS. 1 and 2, the second wall 26 supports the toner cartridge 6 in the state in which the toner cartridge 6 is mounted on the drawer 4.

3. Details of Drum Cartridge 5

Referring next to FIGS. 6-9B, the drum cartridge 5 will be explained.

Figure 6:
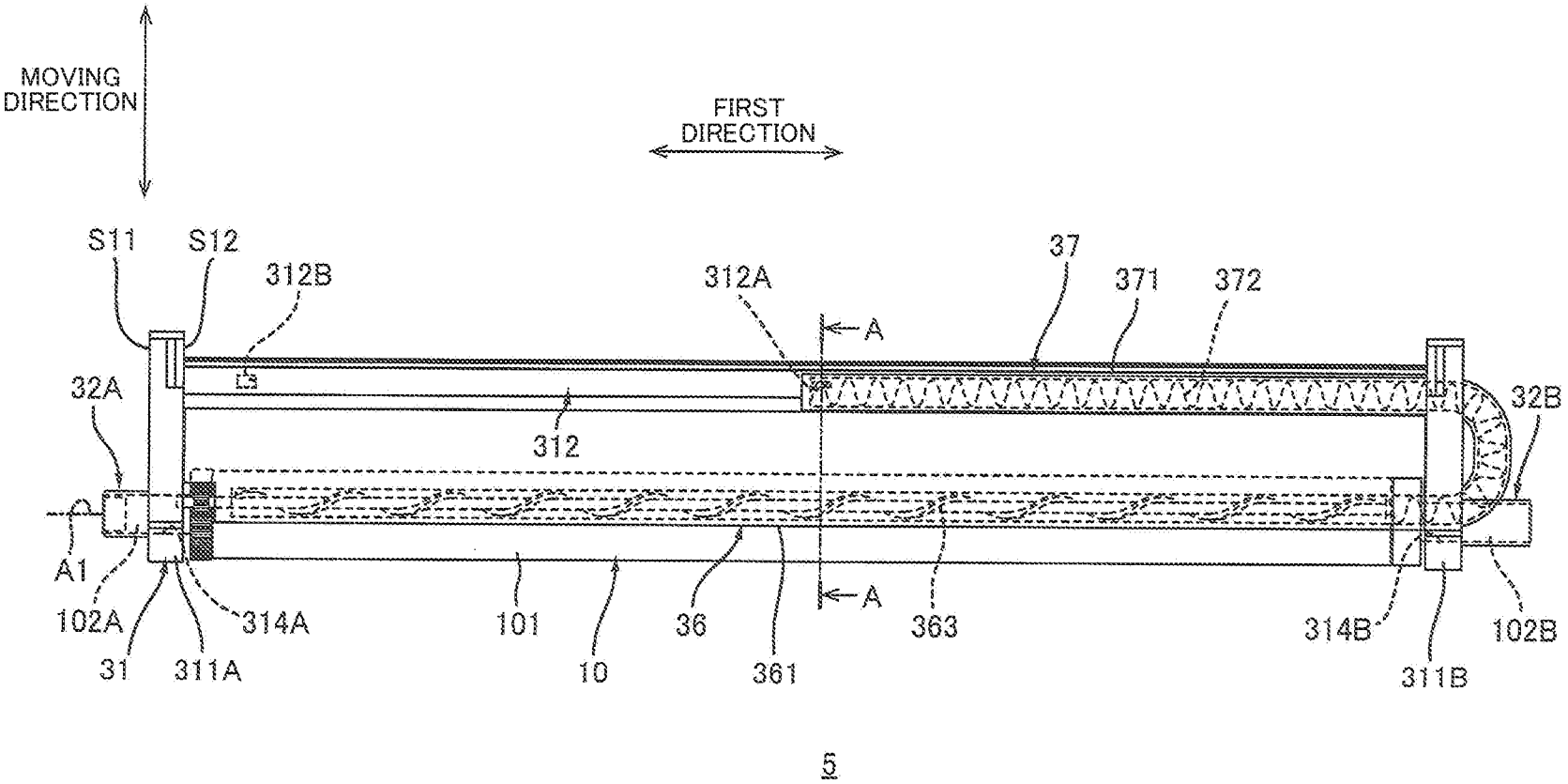
FIG. 6 is a plan view of the drum cartridge.

As shown in FIG. 6, the drum cartridge 5 extends in the first direction. The drum cartridge 5 includes a first end portion in the first direction and a second end portion that is apart from the first end portion in the first direction. The drum cartridge 5 includes a frame 31, the guided portions 32A, 32B, a seal member 34 (FIG. 9A), a shutter 35 (FIG. 9A), a drum cleaner 36, and a waste-toner conveyor pipe 37, in addition to the photoconductive drum 10, the charging roller 11 (FIG. 1), and the developer device 12 (FIG. 1).

3.1 Frame 31

The frame 31 supports the photoconductive drum 10, the charging roller 11, the developer device 12, the shutter 35, and the drum cleaner 36. The frame 31 includes the side plate 311A, a side plate 311B, and a connection portion 312.

3.1.1 Side Plate 311A

The side plate 311A is located at the first end portion of the drum cartridge 5 in the first direction. In other words, the drum cartridge 5 includes the side plate 311A in the first direction. The side plate 311A extends in a direction that intersects the axis A1. Preferably, the side plate 311A extends in a direction orthogonal to the axis A1. Specifically, the side plate 311A extends in the drawer moving direction in the state in which the drum cartridge 5 is mounted on the drawer 4. The side plate 311A includes a first surface S11 and a second surface S12 in the first direction. The second surface S12 is located between the first surface S11 and the side plate 311B in the first direction. The side plate 311A has an aperture 314A and an aperture 315A (not shown). Explanation of the aperture 315B given below is true of the aperture 315A.

The aperture 314A is a through-hole. One end of the photoconductive drum 10 is supported by the aperture 314A.

Specifically, the photoconductive drum 10 includes a drum body 101 and flanges 102A, 102B. The drum body 101 extends in the first direction and has a cylindrical shape. The drum body 101 has a first end portion in the first direction and a second end portion that is apart from the first end portion in the first direction. The flange 102A is located at the first end portion of the drum body 101. The flange 102A is attached to the first end portion of the drum body 101 so as to extend in the first direction. The flange 102A has a cylindrical shape. The flange 102B is located at the second end portion of the drum body 101. The flange 102B is attached to the second end portion of the drum body 101 so as to extend in the first direction. The flange 102B has a cylindrical shape. The flange 102A is supported by the aperture 314A.

3.1.2 Side Plate 311B

The side plate 311B is located at the second end portion of the drawer 4 in the first direction. The side plate 311B is apart from the side plate 311A in the first direction. The side plate 311B extends in the same direction as the side plate 311A. The side plate 311B has an aperture 314B and the aperture 315B (FIG. 7).

The aperture 314B is a through-hole. The flange 102B is supported by the aperture 314B. As described above, the flange 102A is supported by the aperture 314A, and the flange 102B is supported by the aperture 314B, whereby the photoconductive drum 10 is supported by the frame 31.

Figure 7:
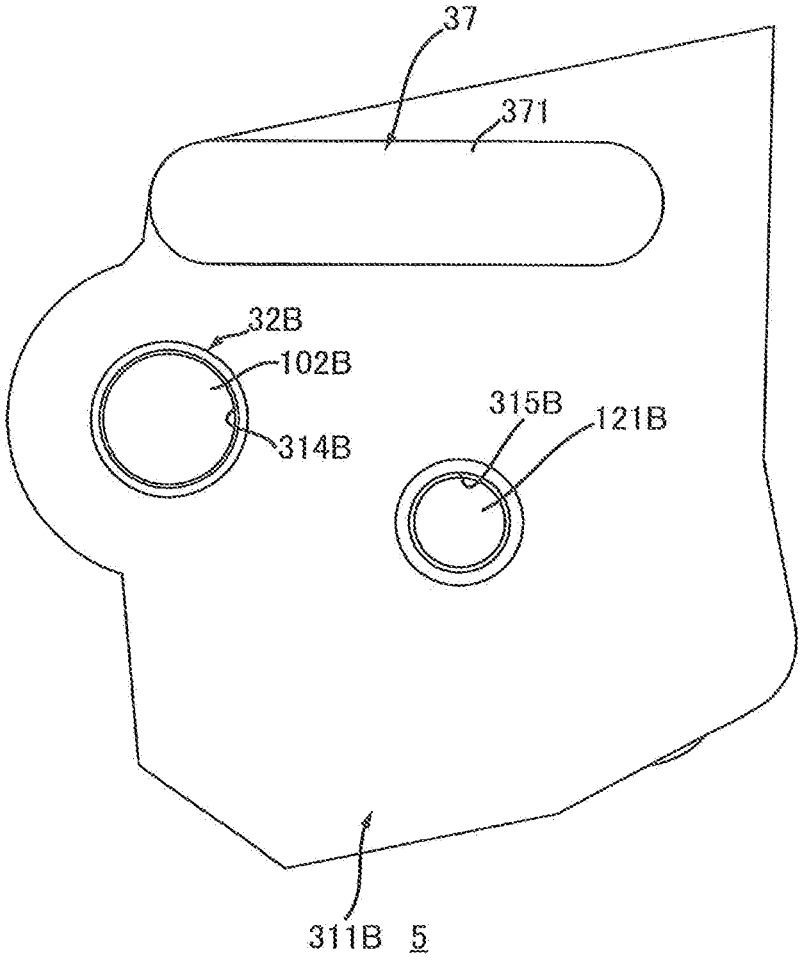
FIG. 7 is a side view of the drum cartridge illustrated in FIG. 6.

As shown in FIG. 7, the aperture 315B is a through-hole. A protrusion 121B of the developer device 12 is held by the aperture 315B.

Figure 8:
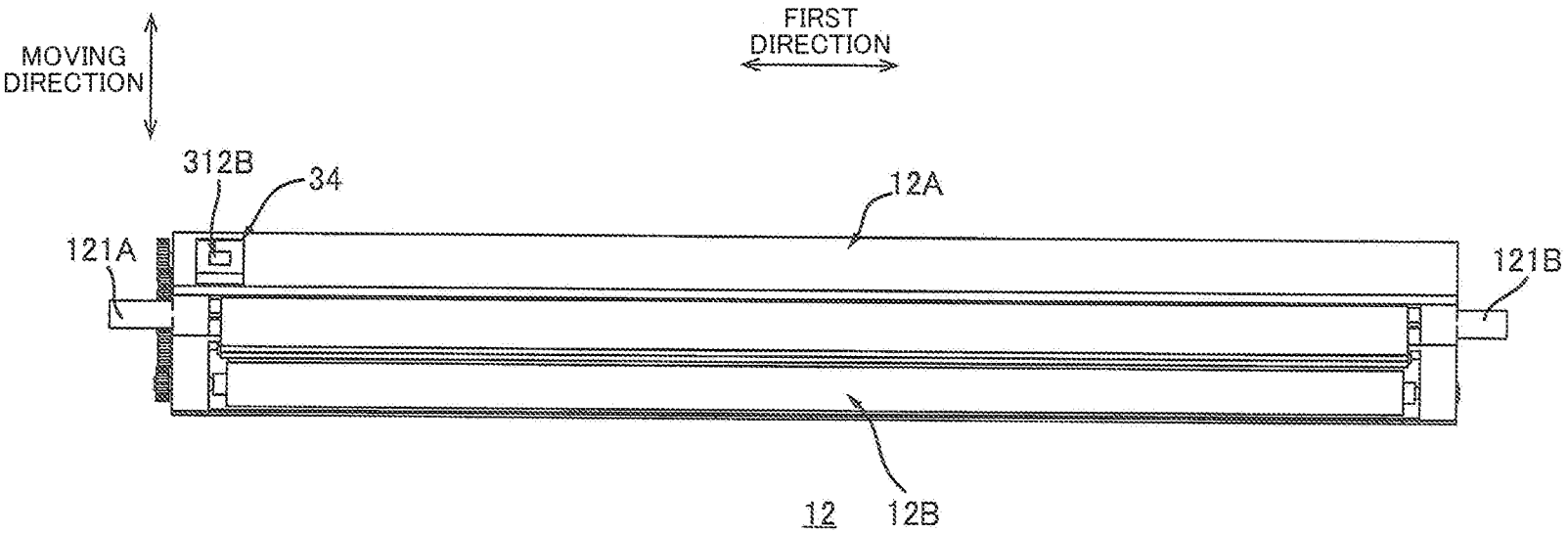
FIG. 8 is a plan view of a developer device.

Specifically, the developer device 12 is located between the side plate 311A and the side plate 311B in the first direction. The developer housing 12A includes a first end portion and a second end portion in the first direction. The second end portion is apart from the first end portion in the first direction. As shown in FIG. 8, the developer device 12 includes a protrusion 121A and the protrusion 121B.

The protrusion 121A is located at the first end portion of the developer housing 12A in the first direction. The protrusion 121A extends in the first direction. The protrusion 121A extends from the first end portion of the developer housing 12A in the first direction. The protrusion 121A may be attached to the first end portion of the developer housing 12A in the first direction. The protrusion 121A has a cylindrical shape. The protrusion 121A is held by the aperture 315A (not shown) of the side plate 311A (FIG. 6).

The protrusion 121B is located at the second end portion of the developer housing 12A in the first direction so as to extend in the first direction. The protrusion 121B extends from the second end portion of the developer housing 12A in the first direction. The protrusion 121B may be attached to the second end portion of the developer housing 12A in the first direction. The protrusion 121B has a cylindrical shape. The protrusion 121B is held by the aperture 315B (FIG. 7) of the side plate 311B. As described above, the protrusion 121A is held by the aperture 315A, and the protrusion 121B is held by the aperture 315B, whereby the developer housing 12A is supported by the frame 31. The developer housing 12A is movable with respect to the frame 31 in the state in which the developer housing 12A is supported by the frame 31.

3.1.3 Connection Portion 312

As shown in FIG. 6, the connection portion 312 is located between the side plate 311A and the side plate 311B in the first direction. The connection portion 312 extends in the first direction. The connection portion 312 includes a first end portion and a second end portion in the first direction. The second end portion is apart from the first end portion in the first direction. The first end portion of the connection portion 312 in the first direction is connected to the side plate 311A, and the second end portion of the connection portion 312 in the first direction is connected to the side plate 311B. In the state in which the drum cartridge 5 and the toner cartridge 6 are mounted on the drawer 4, the connection portion 312 is connected to a toner discharge portion 413 (FIG. 10) and a waste-toner inlet portion 415 (FIG. 10) of the toner cartridge 6.

Figure 9A:
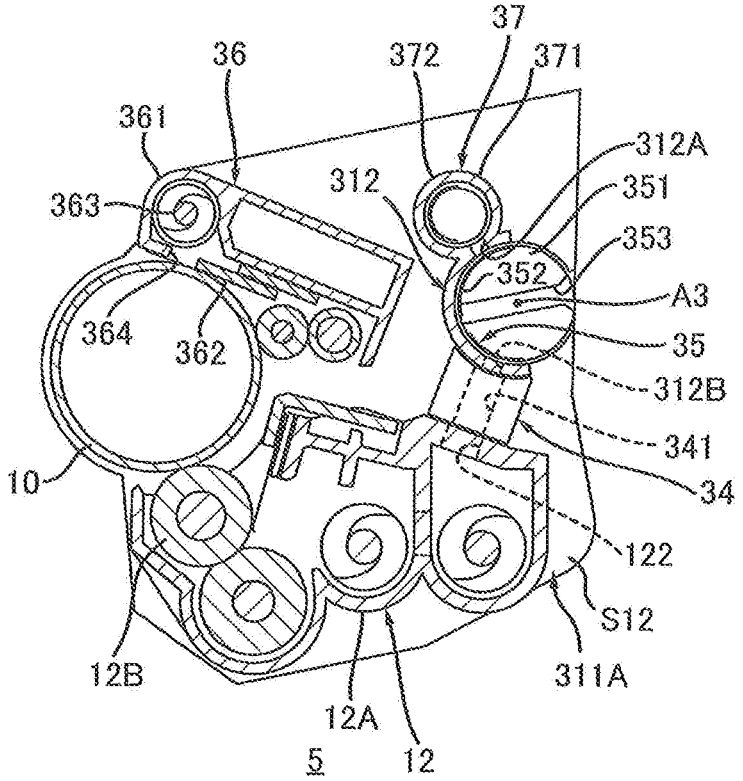
FIG. 9A is a cross-sectional view of the drum cartridge taken along line in A-A FIG. 6, the view illustrating a state in which a shutter is located at a closing position.

As shown in FIG. 9A, the connection portion 312 is apart from the developer device 12. In the state in which the drum cartridge 5 is mounted on the drawer 4, the connection portion 312 is located above the developer device 12. The light L (FIG. 1) emitted from the exposure device 7 passes between the developer device 12 and the connection portion 312. The connection portion 312 has a semi-cylindrical shape.

The connection portion 312 has a waste-toner discharge opening 312A and the toner inlet opening 312B. In other words, the drum cartridge 5 has the waste-toner discharge opening 312A and the toner inlet opening 312B.

As shown in FIG. 6, the waste-toner discharge opening 312A is located at a central portion of the connection portion 312 in the first direction. The toner conveyed by the waste-toner conveyor pipe 37 can be discharged through the waste-toner discharge opening 312A. The waste-toner discharge opening 312A communicates with an inner space of the waste-toner conveyor pipe 37.

The toner inlet opening 312B is located at the first end portion of the connection portion 312 in the first direction. In the state in which the drum cartridge 5 and the toner cartridge 6 are mounted on the drawer 4 (FIG. 1), the toner discharged from the toner discharge opening 416 (FIG. 10) of the toner cartridge 6 can be received by the toner inlet opening 312B.

As shown in FIG. 9A, the toner inlet opening 312B communicates with an inner space of the developer housing 12A. Specifically, the developer housing 12A has a through-hole 122 (as one example of "first through-hole") that communicates with the inner space of the developer housing 12A. The toner inlet opening 312B communicates with the through-hole 122. The toner inlet opening 312B communicates with the inner space of the developer housing 12A via the through-hole 122.

3.2 Guided Portion 32A

As shown in FIG. 6, the guided portion 32A is located opposite to the side plate 311B with respect to the side plate 311A in the first direction. The guided portion 32A is located on the first surface S11 of the side plate 311A. The guided portion 32A is a protrusion. The guided portion 32A extends from the first surface S11 of the side plate 311A. The guided portion 32A may be attached to the first surface S11 of the side plate 311A. The guided portion 32A extends in the first direction. The guided portion 32A extends along the axis A1 and has a cylindrical shape.

In the present embodiment, one end of the photoconductive drum 10 in the first direction is fitted to the guided portion 32A. Specifically, the flange 102A of the photoconductive drum 10 is fitted to the guided portion 32A. The guided portion 32A may be the one end of the photoconductive drum 10 in the first direction. The guided portion 32A may be the flange 102A of the photoconductive drum 10. The one end of the photoconductive drum 10 in the first direction need not necessarily be fitted to the guided portion 32A.

In mounting the drum cartridge 5 on the drawer 4 (FIGS. 3 and 4), the guided portion 32A is guided by the guide 28 (FIG. 3) of the drawer 4.

3.3 Guided Portion 32B

The guided portion 32B is located opposite to the side plate 311A with respect to the side plate 311B in the first direction. The guided portion 32B is apart from the guided portion 32A in the first direction. The above explanation of the guided portion 32A is true of the guided portion 32B. Thus, explanation of the guided portion 32B is dispensed with.

3.4 Seal Member 34

As shown in FIG. 9A, the seal member 34 is provided between the connection portion 312 and the developer housing 12A. The seal member 34 seals between the connection portion 312 and the developer housing 12A. In other words, the seal member 34 seals between the frame 31 and the developer housing 12A. The seal member 34 is provided so as to surround the through-hole 122 of the developer housing 12A. Thus, the seal member 34 does not interfere with the light L (FIG. 1) emitted from the exposure device 7. The seal member 34 surrounds the through-hole 122 of the developer housing 12A and the toner inlet opening 312B. This configuration prevents leakage of the toner received by the toner inlet opening 312B from between the connection portion 312 and the developer housing 12A. The seal member 34 has elasticity. Specifically, the seal member 34 is a sponge. The seal member 34 has a through-hole 341 (as one example of "second through-hole") that communicates with the toner inlet opening 312B and the through-hole 122. In this configuration, the toner received by the toner inlet opening 312B enters the developer housing 12A via the through-hole 341 and the through-hole 122.

3.7 Shutter 35

Figure 9B:
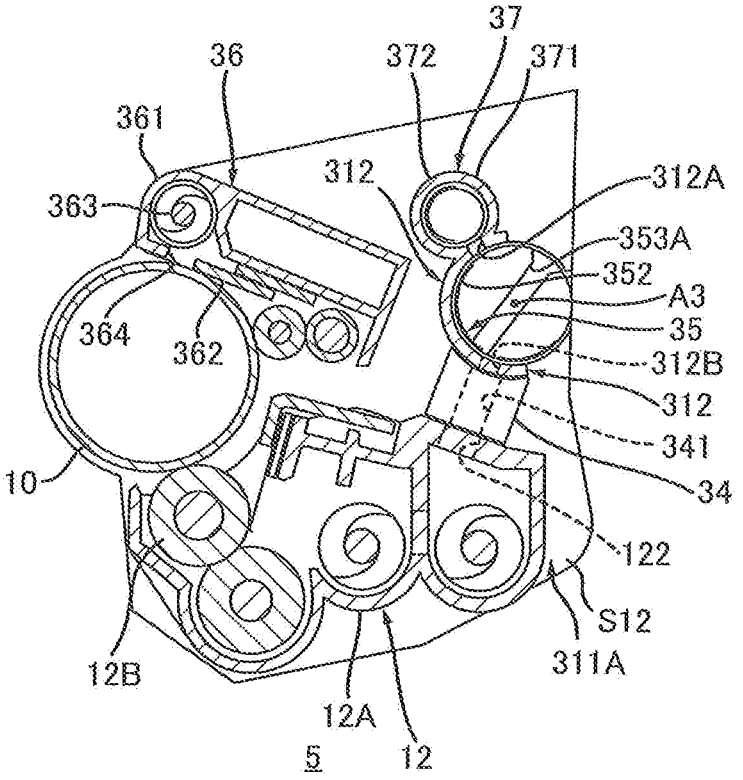
FIG. 9B is a view of the drum cartridge of FIG. 9A, the view illustrating a state in which the shutter is located at an open position.

As shown in FIGS. 9A and 9B, the shutter 35 is movable between a closing position (FIG. 9A) and an open position (FIG. 9B). The shutter 35 is pivotable about an axis A3 between the closing position and the open position. As shown in FIG. 9A, when the shutter 35 is located at the closing position, the shutter 35 closes the toner inlet opening 312B and the waste-toner discharge opening 312A. As shown in FIG. 9B, when the shutter 35 is located at the open position, the shutter 35 opens the toner inlet opening 312B and the waste-toner discharge opening 312A. The shutter 35 extends in the first direction. The shutter 35 includes a first end portion in the first direction and a second end portion that is apart from the first end portion in the first direction. As shown in FIG. 9A, the shutter 35 includes a pair of end plates 351 and a shutter body 352.

3.7.1 End Plate 351

The following explanation will be made focusing on one end plate 351. The end plate 351 is located at the first end portion of the shutter 35 in the first direction. The end plate 351 is located on the second surface S12 of the side plate 311A of the frame 31. The end plate 351 is a circular plate. The end plate 351 is rotatable about the axis A3. The end plate 351 has a groove 353. In other words, the shutter 35 has the groove 353.

The groove 353 extends in the radial direction of the end plate 351. In the state in which the drum cartridge 5 and the toner cartridge 6 are mounted on the drawer 4, a protrusion 462A (FIG. 10) of the toner cartridge 6 engages the groove 353.

3.7.2 Shutter Body 352

As shown in FIG. 9A, the shutter body 352 closes the waste-toner discharge opening 312A and the toner inlet opening 312B in the state in which the shutter 35 is located at the closing position. The shutter body 352 extends in the first direction. The shutter body 352 is connected to the end plate 351. The shutter body 352 is pivotable about the axis A3 together with the end plate 351.

3.8 Drum Cleaner 36

As shown in FIG. 6, the drum cleaner 36 is located between the side plate 311A and the side plate 311B in the first direction. The drum cleaner 36 extends in the first direction. The drum cleaner 36 includes a first end portion in the first direction and a second end portion that is apart from the first end portion in the first direction. The first end portion of the drum cleaner 36 is connected to the side plate 311A, and the second end portion of the drum cleaner 36 is connected to the side plate 311B. The drum cleaner 36 collects waste toner remaining on the surface of the photoconductive drum 10 without being transferred to the sheet S.

As shown in FIG. 9A, the drum cleaner 36 includes a cleaner housing 361, a cleaning member 362, and an auger screw 363. In other words, the drum cartridge includes the cleaner housing 361, the cleaning member 362, and the auger screw 363.

3.8.1 Cleaner Housing 361

As shown in FIG. 6, the cleaner housing 361 is located between the side plate 311A and the side plate 311B in the first direction. The cleaner housing 361 extends in the first direction. The cleaner housing 361 includes a first end portion and a second end portion in the first direction. The first end portion of the cleaner housing 361 is connected to the side plate 311A, and the second end portion of the cleaner housing 361 is connected to the side plate 311B.

As shown in FIG. 9A, the cleaner housing 361 has an opening 364.

3.8.2 Cleaning Member 362

The cleaning member 362 is attached to the cleaner housing 361. The cleaning member 362 is a cleaning blade. The cleaning member 362 is in contact with the surface of the photoconductive drum 10 at an edge thereof. When the photoconductive drum 10 rotates, the waste toner on the surface of the photoconductive drum 10 comes into contact with the edge of the cleaning member 362, so as to be removed from the surface of the photoconductive drum 10. Thus, the cleaning member 362 cleans the surface of the photoconductive drum 10. The removed waste toner is stored in the cleaner housing 361 through the opening 364.

3.8.3 Auger Screw 363

The auger screw 363 is disposed in the cleaner housing 361.

As shown in FIG. 6, the auger screw 363 extends in the first direction. The auger screw 363 conveys the waste toner in the cleaner housing 361 toward the waste-toner conveyor pipe 37.

0.9 Waste-Toner Conveyor Pipe 37

As shown in FIG. 6, the waste-toner conveyor pipe 37 conveys the waste toner from the drum cleaner 36 to the waste-toner discharge opening 312A. Specifically, the waste-toner conveyor pipe 37 conveys the waste toner in the cleaner housing 361 to the waste-toner discharge opening 312A. In other words, the waste-toner conveyor pipe 37 conveys the waste toner removed from the surface of the photoconductive drum 10 by the cleaning member 362.

The waste-toner conveyor pipe 37 includes a pipe 371 and a screw 372.

The pipe 371 includes a first end portion and a second end portion that is apart from the first end portion. The first end portion of the pipe 371 is connected to the cleaner housing 361 of the drum cleaner 36, and the second end portion of the pipe 371 is connected to the connection portion 312. An inner space of the pipe 371 communicates with an inner space of the cleaner housing 361 and the waste-toner discharge opening 312A. Thus, the waste toner in the cleaner housing 361 is discharged from the waste-toner discharge opening 312A through the pipe 371 in the state in which the shutter 35 is located at the open position.

The screw 372 is disposed in the pipe 371. The screw 372 conveys the waste toner in the pipe 371 toward the waste-toner discharge opening 312A. The screw 372 extends in a direction in which the pipe 371 extends. The screw 372 is connected to the auger screw 363. The screw 372 is rotatable together with the auger screw 363. Specifically, the screw 372 is a shaftless screw.

4. Details of Toner Cartridge 6

Referring next to FIGS. 10-14B, the toner cartridge 6 will be explained.

Figure 10:
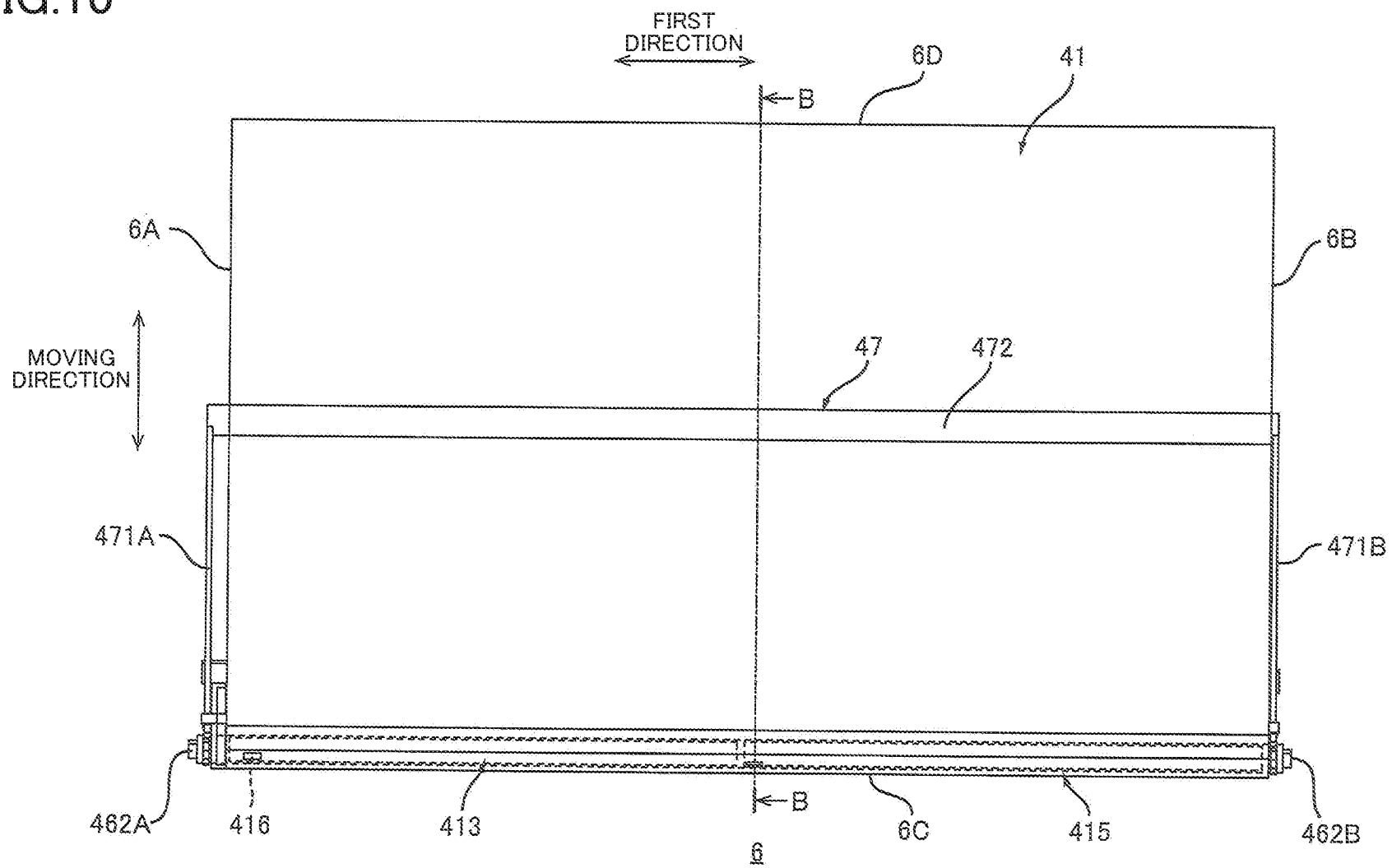
FIG. 10 is a plan view of the toner cartridge.
Figure 11A:
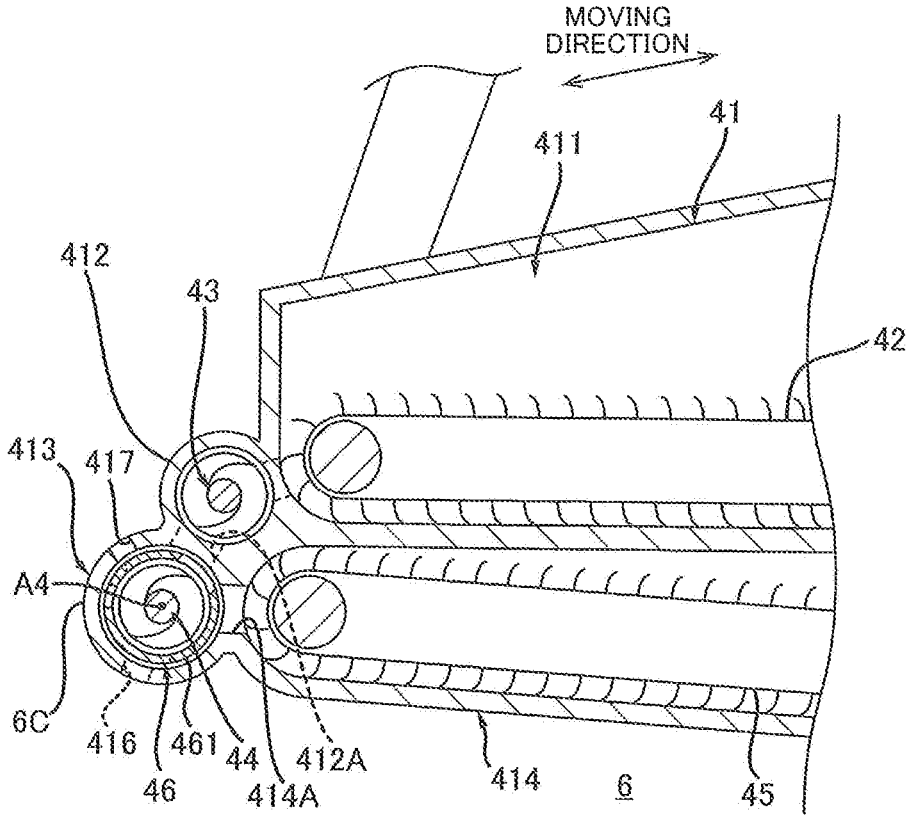
FIG. 11A is a cross-sectional view of the toner cartridge taken along line B-B in FIG. 10, the view illustrating a state in which a shutter is located at a closing position.

As shown in FIG. 10, the toner cartridge 6 extends in the first direction. The toner cartridge 6 includes a first end portion 6A and a second end portion 6B in the first direction. The second end portion 6B is apart from the first end portion 6A in the first direction. The toner cartridge 6 extends in the drawer moving direction. The toner cartridge 6 includes a first end portion 6C and a second end portion 6D in the drawer moving direction. The second end portion 6D is apart from the first end portion 6C in the drawer moving direction. As shown in FIGS. 10 and 11A, the toner cartridge 6 includes a toner cartridge housing 41, a belt conveyor 42 (FIG. 11A), an auger screw 43 (FIG. 11A), an auger screw 44 (FIG. 11A), a belt conveyor 45 (FIG. 11A), a shutter 46 (FIG. 11A), and a handle 47.

4.1 Toner Cartridge Housing 41

Figure 14A:
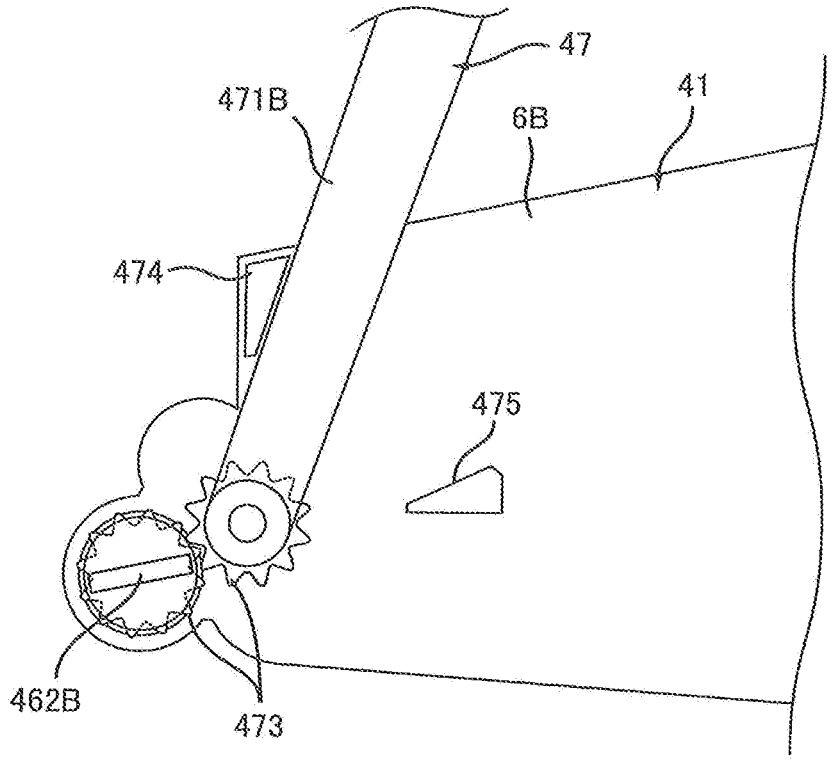
FIG. 14A is a side view of the toner cartridge in a state in which a handle is located at a first position.

As shown in FIG. 11A, the toner cartridge housing 41 includes a toner storage portion 411, a toner storage portion 412, the toner discharge portion 413, a waste-toner storage portion 414, the waste-toner inlet portion 415 (FIG. 10), and stoppers 474, 475 (FIG. 14A).

4.1.1 Toner Storage Portion 411

The toner storage portion 411 stores the toner.

4.1.2 Toner Storage Portion 412

The toner storage portion 412 is located at the first end portion 6C of the toner cartridge 6 in the drawer moving direction. The toner storage portion 412 is connected to the toner storage portion 411. An inner space of the toner storage portion 412 communicates with an inner space of the toner storage portion 411. The toner storage portion 412 stores the toner that flows thereinto from the toner storage portion 411.

Figure 12:
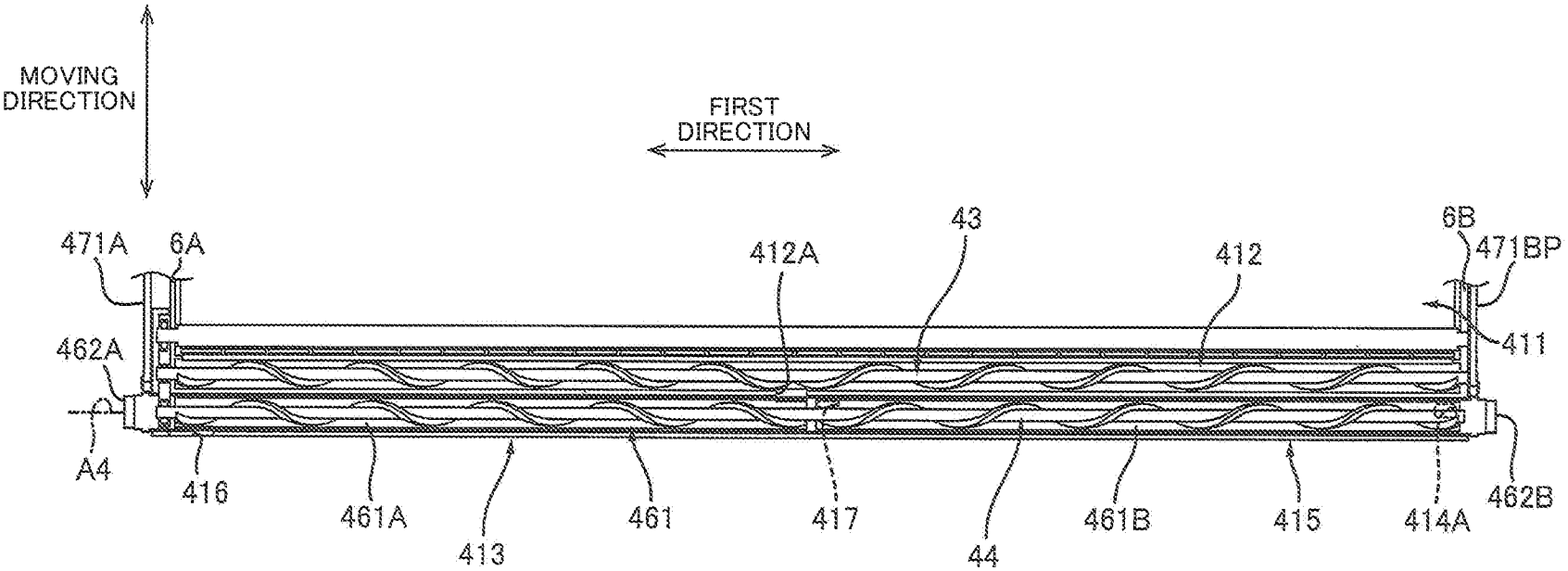
FIG. 12 is a cross-sectional view of the toner cartridge taken along line C-C in FIG. 11B.

As shown in FIG. 12, the toner storage portion 412 extends in the first direction. The toner storage portion 412 extends from the first end portion 6A of the toner cartridge 6 in the first direction to the second end portion 6B of the toner cartridge 6 in the first direction. The toner storage portion 412 has a through-hole 412A. The through-hole 412A is located at a central portion of the toner storage portion 412 in the first direction. The through-hole 412A communicates with the inner space of the toner storage portion 412 and an inner space of the toner discharge portion 413.

4.1.3 Toner Discharge Portion 413

As shown in FIGS. 11A and 12, the toner discharge portion 413 is located at the first end portion 6C of the toner cartridge 6 in the drawer moving direction. The toner discharge portion 413 is connected to the toner storage portion 412. The inner space of the toner discharge portion 413 communicates with the inner space of the toner storage portion 412 via the through-hole 412A. The toner discharge portion 413 is capable of discharging the toner.

The toner discharge portion 413 extends in the first direction. The toner discharge portion 413 extends from the first end portion 6A of the toner cartridge 6 in the first direction to a central portion of the toner cartridge 6 in the first direction. The toner discharge portion 413 has a cylindrical shape. The toner discharge portion 413 has a toner discharge opening 416. In other words, the toner cartridge 6 has the toner discharge opening 416.

The toner discharge opening 416 is located at the first end portion 6A of the toner cartridge 6 in the first direction. The toner discharge opening 416 communicates with the inner space of the toner discharge portion 413. The toner in the toner discharge portion 413 is discharged through the toner discharge opening 416.

4.1.4 Waste-Toner Storage Portion 414

As shown in FIG. 11A, the waste-toner storage portion 414 is located below the toner storage portion 411 in the state in which the toner cartridge 6 and the drum cartridge 5 are mounted on the drawer 4. The waste-toner storage portion 414 stores the waste toner. An inner space of the waste-toner storage portion 414 does not communicate with the inner space of the toner storage portion 411, the inner space of the toner storage portion 412, and the inner space of the toner discharge portion 413. The waste-toner storage portion 414 has a through-hole 414A. The through-hole 414A is apart from a waste-toner inlet opening 417 (FIG. 12) in the first direction. The waste-toner inlet opening 417 will be later explained. The through-hole 414A communicates with the inner space of the waste-toner storage portion 414 and an inner space of the waste-toner inlet portion 415.

4.1.5 Waste-Toner Inlet Portion 415

As shown in FIG. 11A, the waste-toner inlet portion 415 is located at the first end portion 6C of the toner cartridge 6 in the drawer moving direction. The waste-toner inlet portion 415 is capable of receiving the waste toner.

As shown in FIG. 12, the waste-toner inlet portion 415 extends in the first direction. The waste-toner inlet portion 415 extends from the second end portion 6B of the toner cartridge 6 in the first direction to the central portion of the toner cartridge 6 in the first direction. The waste-toner inlet portion 415 and the toner discharge portion 413 are arranged in the first direction. The inner space of the waste-toner inlet portion 415 communicates with the inner space of the waste-toner storage portion 414 (FIG. 11A) via the through-hole 414A. The inner space of the waste-toner inlet portion 415 does not communicate with the inner space of the toner storage portion 411, the inner space of the toner storage portion 412, and the inner space of the toner discharge portion 413. The waste-toner inlet portion 415 has a cylindrical shape. The waste-toner inlet portion 415 has a waste-toner inlet opening 417. In other words, the toner cartridge 6 has the waste-toner inlet opening 417.

The waste-toner inlet opening 417 is located at the central portion of the toner cartridge 6 in the first direction. In the state in which the drum cartridge 5 and the toner cartridge 6 are mounted on the drawer 4, the waste-toner inlet opening 417 communicates with the waste-toner discharge opening 312A (FIG. 6), whereby the waste-toner inlet opening 417 receives the waste toner conveyed by the waste-toner conveyor pipe 37. The waste-toner inlet opening 417 communicates with the inner space of the waste-toner inlet portion 415, whereby the waste toner received by the waste-toner inlet opening 417 enters the waste-toner inlet portion 415.

4.1.6 Stoppers 474, 475

As shown in FIG. 14A, the stopper 474 is provided on an outer surface of the toner cartridge housing 41 in the first direction. The stopper 474 protrudes from the outer surface of the toner cartridge housing 41 in the first direction. The stopper 474 may be attached to the outer surface of the toner cartridge housing 41 in the first direction. The stopper 474 stops the handle 47 such that the handle 47 is retained at a first position.

The stopper 475 is provided on the outer surface of the toner cartridge housing 41 in the first direction. The stopper 475 protrudes from the outer surface of the toner cartridge housing 41 in the first direction. The stopper 475 may be attached to the outer surface of the toner cartridge housing 41 in the first direction. The stopper 475 is apart from the stopper 474. The stopper 475 stops the handle 47 such that the handle 47 is retained at the second position.

4.2 Belt Conveyor 42

As shown in FIG. 11A, the belt conveyor 42 is disposed in the toner storage portion 411. The belt conveyor 42 conveys the toner in the toner storage portion 411 toward the toner storage portion 412.

4.3 Auger Screw 43

The auger screw 43 is disposed in the toner storage portion 412. As shown in FIG. 12, the auger screw 43 extends in the first direction. The auger screw 43 conveys the toner in the toner storage portion 412 toward the through-hole 412A.

4.4 Auger Screw 44

As shown in FIG. 11A, the auger screw 44 is located in the toner discharge portion 413 and the waste-toner inlet portion 415. That is, the auger screw 44 has a part located in the toner discharge portion 413 and a part located in the waste-toner inlet portion 415. The auger screw 44 extends in the first direction. The part of the auger screw 44 located in the toner discharge portion 413 conveys the toner in the toner discharge portion 413 toward the toner discharge opening 416. The part of the auger screw 44 located in the waste-toner inlet portion 415 conveys the toner in the waste-toner inlet portion 415 toward the through-hole 414A.

4.5 Belt Conveyor 45

The belt conveyor 45 is disposed in the waste-toner storage portion 414. The belt conveyor 45 conveys the toner in the waste-toner storage portion 414 in a direction away from the through-hole 414A.

4.6 Shutter 46

Figure 11B:
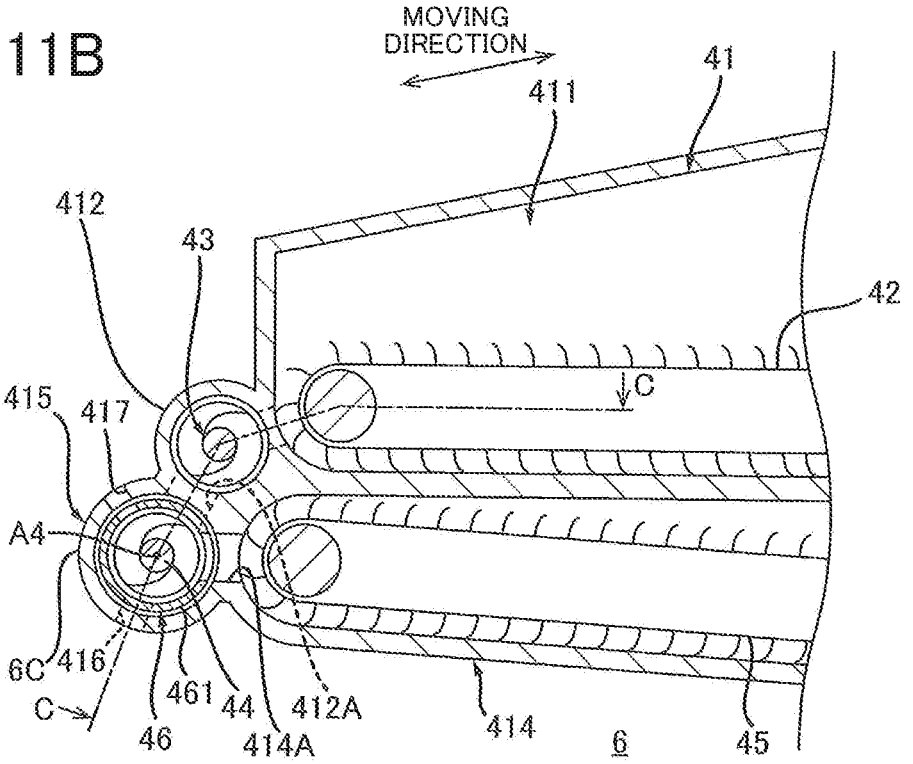
FIG. 11B is a view of the toner cartridge of FIG. 11A, the view illustrating a state in which the shutter is located at the open position.

As shown in FIGS. 11A and 11B, the shutter 46 is movable between a closing position (FIG. 11A) and an open position (FIG. 11B). Specifically, the shutter 46 is pivotable about an axis A4 between the closing position and the open position.

As shown in FIG. 11A, the shutter 46 closes the toner discharge opening 416 in the state in which the shutter 46 is located at the closing position. The shutter 46 also closes the waste-toner inlet opening 417 in the state in which the shutter 46 is located at the closing position.

As shown in FIG. 11B, the shutter 46 opens the toner discharge opening 416 in the state in which the shutter 46 is located at the open position. The shutter 46 also opens the waste-toner inlet opening 417 in the state in which the shutter 46 is located at the open position.

As shown in FIG. 12, the shutter 46 includes a shutter body 461 and protrusions 462A, 462B.

4.5.1 Shutter Body 461

The shutter body 461 extends in the first direction. The shutter body 461 is located in the toner discharge portion 413 and the waste-toner inlet portion 415. That is, the shutter body 461 includes a first portion 461A located in the toner discharge portion 413 and a second portion 461B located in the waste-toner inlet portion 415. The first portion 461A closes the toner discharge opening 416 in the state in which the shutter 46 is located at the closing position (FIG. 11A). The second portion 461B closes the waste-toner inlet opening 417 in the state in which the shutter 46 is located at the closing position. The shutter body 461 is rotatable about the axis A4.

4.5.2 Protrusion 462A

As shown in FIG. 12, the protrusion 462A is located at the first end portion 6A of the toner cartridge 6 in the first direction. The protrusion 462A is connected to the first portion 461A of the shutter 46, whereby the protrusion 462A is rotatable about the axis A4 together with the shutter 46. The protrusion 462A is a rib. The protrusion 462A extends in a direction that intersects the axis A4. Preferably, the protrusion 462A extends in a direction orthogonal to the axis A4.

The protrusion 462A engages the groove 353 (FIG. 9A) of the drum cartridge 5 when the toner cartridge 6 is mounted on the drawer 4 in the state in which the drum cartridge 5 is mounted on the drawer 4.

Figure 13A:
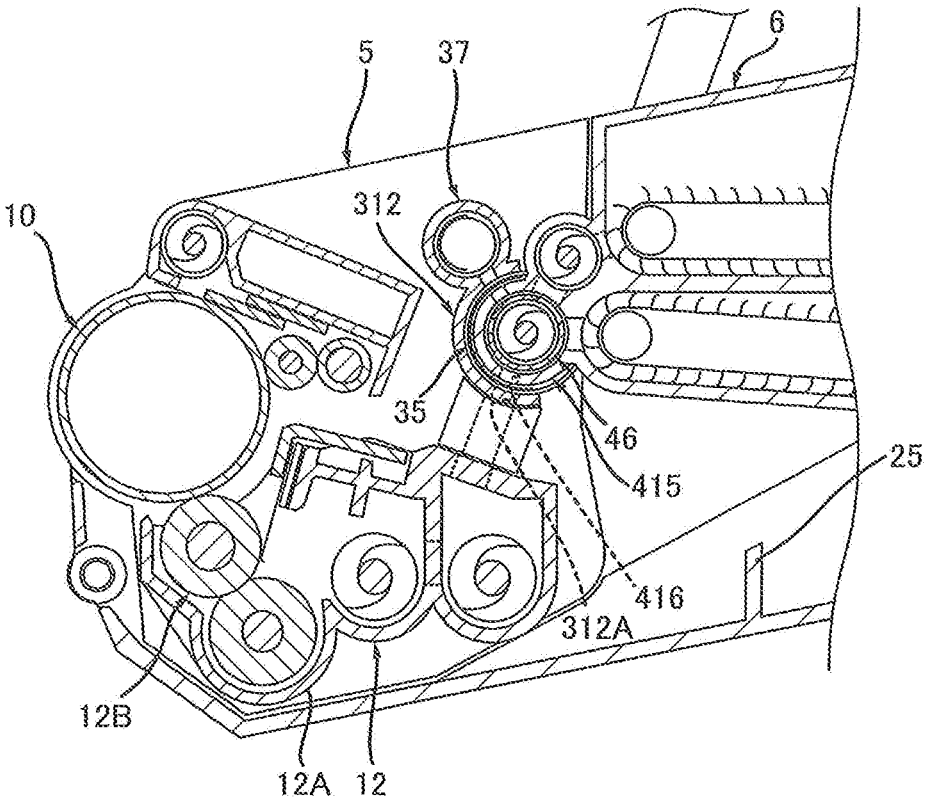
FIG. 13A is an explanatory view for explaining a movement of the shutter of the drum cartridge and the shutter of the toner cartridge that move in conjunction with each other, the view illustrating a state in which the shutter of the drum cartridge is located at the closing position and the shutter of the toner cartridge is located at the closing position.
Figure 13B:
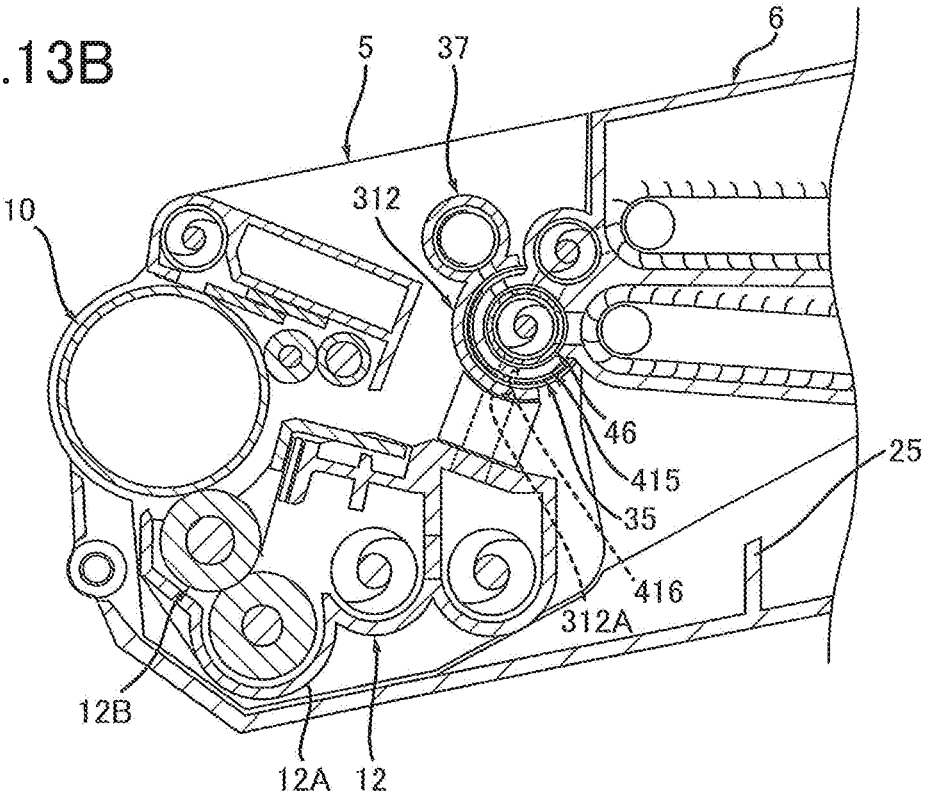
FIG. 13B is an explanatory view for explaining the movement of the shutter of the drum cartridge and the shutter of the toner cartridge that move in conjunction with each other, the view illustrating a state in which the shutter of the drum cartridge is located at the open position and the shutter of the toner cartridge is located at the open position.

As shown in FIGS. 13A and 13B, the protrusion 462A engages the groove 353, so that the shutter 35 becomes movable together with the shutter 46. As shown in FIG. 13A, the shutter 35 is located at the closing position in the state in which the shutter 46 is located at the closing position. As shown in FIG. 13B, the shutter 35 is located at the open position in the state in which the shutter 46 is located at the open position.

4.5.3 Protrusion 462B

As shown in FIG. 12, the protrusion 462B is apart from the protrusion 462A in the first direction. The protrusion 462B is located at the second end portion 6B of the toner cartridge 6 in the first direction. The protrusion 462B is connected to the second portion 461B of the shutter 46, whereby the protrusion 462B is rotatable about the axis A4 together with the shutter 46. The above explanation of the protrusion 462A is true of the protrusion 462B. Thus, explanation of the protrusion 462B is dispensed with.

4.6 Handle 47

Figure 14B:
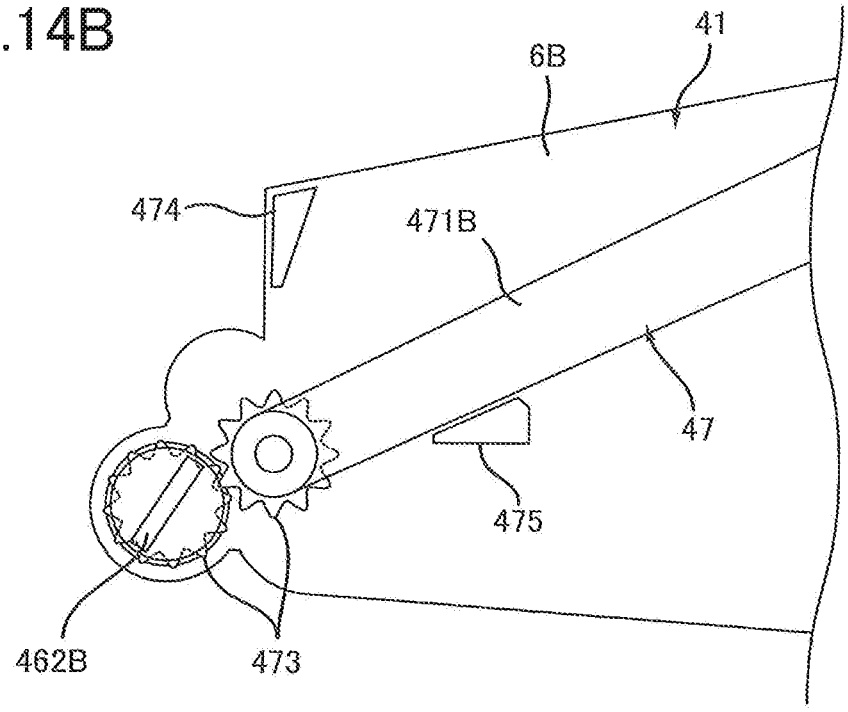
FIG. 14B illustrates a state in which the handle of FIG. 14A is located at a second position.

As shown in FIGS. 2 and 4, the handle 47 is movable between the first position (FIG. 4) and the second position (FIG. 2). Specifically, the handle 47 is pivotable between the first position and the second position. As shown in FIG. 14A, the handle 47 is located at the first position by contacting the stopper 474. As shown in FIG. 14B, the handle 47 is located at the second position by contacting the stopper 475.

As shown in FIGS. 11A and 11B, the handle 47 moves in conjunction with the shutter 46. In the state in which the handle 47 is located at the first position, the shutter 46 is located at the closing position as shown in FIG. 11A. In the state in which the handle 47 is located at the second position, the shutter 46 is located at the open position as shown in FIG. 11B.

As shown in FIG. 10, the handle 47 includes arms 471A, 471B and a grip 472.

The arm 471A is attached to the first end portion 6A of the toner cartridge 6 in the first direction. The arm 471A is pivotable.

The arm 471B is apart from the arm 471A in the first direction. The arm 471B is attached to the second end portion 6B of the toner cartridge 6 in the first direction. The arm 471B is pivotable. The arm 471B is connected to the shutter 46 through two gears 473 (FIG. 14A), whereby the handle 47 can be moved in conjunction with the shutter 46.

The grip 472 is located between the arm 471A and the arm 471B in the first direction so as to extend in the first direction. The grip 472 includes a first end portion in the first direction and a second end portion that is apart from the first end portion in the first direction. The first end portion of the grip 472 in the first direction is connected to the arm 471A, and the second end portion of the grip 472 in the first direction is connected to the arm 471B. In the state in which the drum cartridge 5 and the toner cartridge 6 are mounted on the drawer 4 and the drawer 4 is located at the inside position (FIG. 1), the grip 472 is located inside the housing 2. In the state in which the drum cartridge 5 and the toner cartridge 6 are mounted on the drawer 4 and the drawer 4 is located at the outside position (FIG. 2), the grip 472 is located outside the housing 2. The grip 472 is gripped by the user when the user replaces the toner cartridge 6. In other words, the handle 47 is gripped by the user when the user replaces the toner cartridge 6.

5. Mounting of Drum Cartridge

There will be next explained mounting of the drum cartridge 5 on the drawer 4.

In mounting the drum cartridge 5 on the drawer 4, the user moves the cover 2B to the open position and pulls the drawer 4 out of the housing 2.

As shown in FIG. 3, the user then places the drum cartridge 5 on the drawer 4 in the state in which the drawer 4 is located at the outside position.

When the user places the drum cartridge 5 on the drawer 4 located at the outside position, the side plate 311A of the drum cartridge 5 comes into contact with the guide 27 of the drawer 4 and the guided portion 32A of the drum cartridge 5 comes into contact with the guide 28 of the drawer 4.

The user then slides the drum cartridge 5 toward the housing 2.

In this instance, the side plate 311A of the drum cartridge 5 is guided by the guide 27, and the guided portion 32A of the drum cartridge 5 is guided by the guide 28. Thus, the drum cartridge 5 is slid toward the inside of the housing 2.

When the side plate 311A of the drum cartridge 5 comes into contact with the plate 24, mounting of the drum cartridge 5 on the drawer 4 is completed as shown in FIG. 4.

In detaching the drum cartridge 5 from the drawer 4, the user withdraws the drum cartridge 5 from the drawer 4 in the drawer moving direction in the state in which the drawer 4 is located at the outside position.

Thus, the drum cartridge 5 is detached from the drawer 4.

6. Mounting of Toner Cartridge

There will be next explained mounting of the toner cartridge 6 on the drawer 4.

In mounting the toner cartridge 6 on the drawer 4, the user inserts the protrusion 462A (FIG. 12) of the toner cartridge 6 into the groove 353 (FIG. 9A) of the drum cartridge 5 while gripping the handle 47 located at the first position, in the state in which the drawer 4 is located at the outside position and the drum cartridge 5 is mounted on the drawer 4 as shown in FIG. 4. The user places the toner cartridge 6 on the drawer 4 in the state in which the protrusion 462A of the toner cartridge 6 is engaged in the groove 353 of the drum cartridge 5.

The user then moves the handle 47 from the first position to the second position (FIG. 2).

In this instance, the shutter 46 moves from the closing position to the open position, and the shutter 35 moves from the closing position to the open position.

When the handle 47 is located at the second position as shown in FIG. 2, the shutter 46 is located at the open position and the shutter 35 is located at the open position. Thus, mounting of the toner cartridge 6 on the drawer 4 is completed.

In detaching the toner cartridge 6 from the drawer 4, the user moves the handle 47 of the toner cartridge 6 from the second position to the first position in the state in which the drawer 4 is located at the outside position.

When the handle 47 of the toner cartridge 6 is moved from the second position to the first position, the shutter 46 moves from the open position to the closing position, and the shutter 35 moves from the open position to the closing position.

The user then withdraws the toner cartridge 6 from the drawer 4.

In this instance, the protrusion 462A (FIG. 12) of the toner cartridge 6 is disengaged from the groove 353 (FIG. 9A) of the drum cartridge 5, so that the toner cartridge 6 is detached from the drawer 4.

7. Advantageous Effects (1) In the image forming device 1, the drum cartridge 5 and the toner cartridge 6 are mountable on the drawer 4 in the state in which the drawer 4 is located at the outside position as shown in FIG. 2.

Thus, when the user replaces the toner cartridge 6 and the drum cartridge 5, the user pulls the drawer 4 out of the housing and replaces the toner cartridge 6 and the drum cartridge 5 utilizing a large space outside the housing.

As a result, the toner cartridge 6 and the drum cartridge 5 can be easily replaced.

(2) In the image forming device 1, the through-hole 24A of the drawer 4 is apart from the toner discharge opening 416 in the horizontal direction in the state in which the drum cartridge 5 and the toner cartridge 6 are mounted on the drawer 4 as shown in FIG. 2.

In a case where the toner discharged from the toner discharge opening 416 is not received by the toner inlet opening 312B and accordingly spills outside, the spilled toner is prevented from entering the through-hole 24A.

(3) In the image forming device 1, the toner receiving portion 24B inclines downward as the toner receiving portion gets away from the through-hole 24A of the drawer 4 as shown in FIG. 2.

In this configuration, the toner received by the toner receiving portion 24B flows in a direction away from the through-hole 24A owing to the inclination of the toner receiving portion 24B.

As a result, the toner received by the toner receiving portion 24B is prevented from flowing toward the through-hole 24A.

(4) In the image forming device 1, the drawer 4 includes the first wall 25 as shown in FIG. 2. The first wall 25 is located between the toner receiving portion 24B and the through-hole 24A of the drawer 4.

Thus, the first wall 25 prevents the toner received by the toner receiving portion 24B from flowing toward the through-hole 24A.

(5) In the image forming device 1, the drawer 4 includes the second wall 26 as shown in FIG. 3. The second wall 26 is located above the through-hole 24A of the drawer 4.

Even if the toner spills and flows from the toner discharge opening 416 of the toner cartridge 6 toward the through-hole 24A when the toner cartridge 6 is detached from or mounted on the drawer 4, the spilled toner can be received by the second wall 26.

This configuration prevents the spilled toner from entering the through-hole 24A.

What is claimed is:

1. An image forming device, comprising:

a housing;

a drawer movable between an inside position at which the drawer is located inside the housing and an outside position at which the drawer is located outside the housing;

a drum cartridge including a photoconductive drum and a developer roller and mountable on the drawer; and a toner cartridge storing toner to be supplied to the developer roller and mountable on the drawer, wherein the drum cartridge and the toner cartridge are mountable on the drawer in a state in which the drawer is located at the outside position, wherein the drum cartridge and the toner cartridge are arranged in a drawer moving direction in which the drawer moves, in the state in which the drum cartridge and the toner cartridge are mounted on the drawer, wherein the toner cartridge has a toner discharge opening through which the toner is discharged, wherein the drum cartridge has a toner inlet opening that receives the toner discharged from the toner discharge opening of the toner cartridge, and wherein the drawer has a toner receiving portion located below the toner discharge opening and the toner inlet opening in the state in which the drum cartridge and the toner cartridge are mounted on the drawer, the toner receiving portion being capable of receiving the toner that has not been received by the toner inlet opening.

2. The image forming device according to claim 1, further comprising a transfer roller, wherein the toner cartridge is located opposite to the transfer roller with respect to the drum cartridge in the drawer moving direction of the drawer in the state in which the drum cartridge and the toner cartridge are mounted on the drawer.

3. The image forming device according to claim 1, wherein the drawer includes a plate located below the drum cartridge and the toner cartridge mounted on the drawer, and wherein the toner receiving portion is a part of the plate.

4. The image forming device according to claim 1, further comprising an exposure device, wherein the drawer has a through-hole, and wherein the exposure device exposes a surface of the photoconductive drum through the through-hole of the drawer in a state in which the drum cartridge and the toner cartridge are mounted on the drawer and the drawer is located at the inside position.

5. The image forming device according to claim 4, wherein the through-hole of the drawer is apart from the toner discharge opening in a horizontal direction in the state in which the drum cartridge and the toner cartridge are mounted on the drawer.

6. The image forming device according to claim 5, wherein the toner receiving portion inclines more downward as the toner receiving portion gets away from the through-hole of the drawer.

7. The image forming device according to claim 5, wherein the drawer includes a first wall located between the toner receiving portion and the through-hole of the drawer.

8. The image forming device according to claim 5, wherein the drawer includes a second wall located above the through-hole of the drawer.

9. The image forming device according to claim 8, wherein the second wall supports the toner cartridge in a state in which the toner cartridge is mounted on the drawer.

10. The image forming device according to claim 1, wherein the photoconductive drum is rotatable about an axis that extends in a first direction, wherein the drum cartridge includes a side plate in the first direction, and wherein the drawer includes a first guide that guides the side plate of the drum cartridge in mounting the drum cartridge on the drawer.

11. The image forming device according to claim 10, wherein the drawer includes a second guide that guides the photoconductive drum in mounting the drum cartridge on the drawer.

12. The image forming device according to claim 1, wherein the toner cartridge includes:

a shutter movable between a closing position at which the shutter closes the toner discharge opening and an open position at which the shutter opens the toner discharge opening; and a handle that moves in conjunction with the shutter, the handle being movable between a first position at which the shutter is located at the closing position and a second position at which the shutter is located at the open position.

13. The image forming device according to claim 12, wherein the handle includes a grip, and wherein, in the state in which the toner cartridge and the drum cartridge are mounted on the drawer, the grip is located inside the housing when the drawer is located at the inside position and is located outside the housing when the drawer is located at the outside position.

14. The image forming device according to claim 12, wherein the drum cartridge includes: a cleaning member that cleans a surface of the photoconductive drum; and a waste-toner conveyor pipe that conveys waste toner removed from the surface of the photoconductive drum by the cleaning member, wherein the toner cartridge includes a waste-toner inlet opening that receives the waste toner conveyed by the waste-toner conveyor pipe, wherein the shutter closes the toner discharge opening and the waste-toner inlet opening in a state in which the shutter is located at the closing position, and wherein the shutter opens the toner discharge opening and the waste-toner inlet opening in a state in which the shutter is located at the open position.

15. The image forming device according to claim 1, wherein the drum cartridge includes:

a frame supporting the photoconductive drum and having the toner inlet opening;

a developer housing supporting the developer roller and movable with respect to the frame, the developer housing having a first through-hole that communicates with the toner inlet opening, and a seal member that seals between the frame and the developer housing, the seal member having a second through-hole that communicates with the toner inlet opening and the first through-hole.

16. An image forming device, comprising:

a housing;

a drawer movable between an inside position at which the drawer is located inside the housing and an outside position at which the drawer is located outside the housing;

a drum cartridge including a photoconductive drum and mountable on the drawer;

a developer roller that supplies toner to the photoconductive drum;

a toner cartridge storing the toner to be supplied to the developer roller and mountable on the drawer; and an exposure device, wherein the drum cartridge and the toner cartridge are mountable on the drawer in a state in which the drawer is located at the outside position, wherein the drawer has a through-hole, and wherein the exposure device exposes a surface of the photoconductive drum through the through-hole of the drawer in a state in which the drum cartridge and the toner cartridge are mounted on the drawer and the drawer is located at the inside position.

* * * * *